US008167646B1

(12) United States Patent
Mathews

(10) Patent No.: US 8,167,646 B1
(45) Date of Patent: May 1, 2012

(54) CONNECTOR HAVING ELECTRICAL CONTINUITY ABOUT AN INNER DIELECTRIC AND METHOD OF USE THEREOF

(75) Inventor: Roger D. Mathews, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 11 days.

(21) Appl. No.: 12/906,243

(22) Filed: Oct. 18, 2010

(51) Int. Cl.
*H01R 9/05* (2006.01)

(52) U.S. Cl. ..... 439/578

(58) Field of Classification Search ..... 439/578–581, 439/271, 63
See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |

(Continued)

FOREIGN PATENT DOCUMENTS

CA 2096710 A1 11/1994

(Continued)

OTHER PUBLICATIONS

Digicon AVL Connector. Arris Group Inc. [online]. 3 pages. [retrieved on Apr. 22, 2010]. Retrieved from the Internet:<URL: http://www.arrisi.com/special/digiconAVL.asp>.

(Continued)

*Primary Examiner* — Javaid Nasri
(74) *Attorney, Agent, or Firm* — Schmeiser Olsen & Watts

(57) ABSTRACT

A connector having a conductive member is provided, wherein the conductive member electrically couples a dielectric and a post, thereby establishing electrical continuity about an inner dielectric throughout the connector. Furthermore, the conductive member facilitates grounding through the connector, and renders an electromagnetic shield preventing ingress of unwanted environmental noise.

29 Claims, 16 Drawing Sheets

U.S. PATENT DOCUMENTS

| | | | | |
|---|---|---|---|---|
| 3,406,373 | A | | 10/1968 | Forney, Jr. |
| 3,448,430 | A | | 6/1969 | Kelly |
| 3,453,376 | A | | 7/1969 | Ziegler, Jr. et al. |
| 3,465,281 | A | | 9/1969 | Florer |
| 3,475,545 | A | | 10/1969 | Stark et al. |
| 3,498,647 | A | | 3/1970 | Schroder |
| 3,517,373 | A | | 6/1970 | Jamon |
| 3,533,051 | A | | 10/1970 | Ziegler, Jr. |
| 3,537,065 | A | | 10/1970 | Winston |
| 3,544,705 | A | | 12/1970 | Winston |
| 3,551,882 | A | | 12/1970 | O'Keefe |
| 3,564,487 | A | | 2/1971 | Upstone et al. |
| 3,587,033 | A | | 6/1971 | Brorein et al. |
| 3,601,776 | A | | 8/1971 | Curl |
| 3,629,792 | A | | 12/1971 | Dorrell |
| 3,633,150 | A | | 1/1972 | Swartz |
| 3,646,502 | A | | 2/1972 | Hutter et al. |
| 3,663,926 | A | | 5/1972 | Brandt |
| 3,665,371 | A | | 5/1972 | Cripps |
| 3,668,612 | A | | 6/1972 | Nepovim |
| 3,669,472 | A | | 6/1972 | Nadsady |
| 3,671,922 | A | | 6/1972 | Zerlin et al. |
| 3,678,445 | A | | 7/1972 | Brancaleone |
| 3,678,455 | A | | 7/1972 | Levey |
| 3,680,034 | A | | 7/1972 | Chow et al. |
| 3,681,739 | A | | 8/1972 | Kornick |
| 3,683,320 | A | | 8/1972 | Woods et al. |
| 3,686,623 | A | | 8/1972 | Nijman |
| 3,694,792 | A | | 9/1972 | Wallo |
| 3,706,958 | A | | 12/1972 | Blanchenot |
| 3,710,005 | A | | 1/1973 | French |
| 3,739,076 | A | | 6/1973 | Schwartz |
| 3,744,007 | A | | 7/1973 | Horak |
| 3,744,011 | A | | 7/1973 | Blanchenot |
| 3,778,535 | A | | 12/1973 | Forney, Jr. |
| 3,781,762 | A | | 12/1973 | Quackenbush |
| 3,781,898 | A | | 12/1973 | Holloway |
| 3,793,610 | A | | 2/1974 | Brishka |
| 3,798,589 | A | | 3/1974 | Deardurff |
| 3,808,580 | A | | 4/1974 | Johnson |
| 3,810,076 | A | | 5/1974 | Hutter |
| 3,835,443 | A | | 9/1974 | Arnold et al. |
| 3,836,700 | A | | 9/1974 | Niemeyer |
| 3,845,453 | A | | 10/1974 | Hemmer |
| 3,846,738 | A | * | 11/1974 | Nepovim ..... 439/584 |
| 3,854,003 | A | | 12/1974 | Duret |
| 3,879,102 | A | | 4/1975 | Horak |
| 3,886,301 | A | | 5/1975 | Cronin et al. |
| 3,907,399 | A | | 9/1975 | Spinner |
| 3,910,673 | A | | 10/1975 | Stokes |
| 3,915,539 | A | | 10/1975 | Collins |
| 3,936,132 | A | | 2/1976 | Hutter |
| 3,953,097 | A | | 4/1976 | Graham |
| 3,963,320 | A | | 6/1976 | Spinner |
| 3,963,321 | A | | 6/1976 | Burger et al. |
| 3,970,355 | A | | 7/1976 | Pitschi |
| 3,972,013 | A | | 7/1976 | Shapiro |
| 3,976,352 | A | | 8/1976 | Spinner |
| 3,980,805 | A | | 9/1976 | Lipari |
| 3,985,418 | A | | 10/1976 | Spinner |
| 4,030,798 | A | | 6/1977 | Paoli |
| 4,046,451 | A | | 9/1977 | Juds et al. |
| 4,053,200 | A | | 10/1977 | Pugner |
| 4,059,330 | A | | 11/1977 | Shirey |
| 4,079,343 | A | | 3/1978 | Nijman |
| 4,082,404 | A | | 4/1978 | Flatt |
| 4,090,028 | A | | 5/1978 | Vontobel |
| 4,093,335 | A | | 6/1978 | Schwartz et al. |
| 4,106,839 | A | | 8/1978 | Cooper |
| 4,125,308 | A | | 11/1978 | Schilling |
| 4,126,372 | A | | 11/1978 | Hashimoto et al. |
| 4,131,332 | A | | 12/1978 | Hogendobler et al. |
| 4,150,250 | A | | 4/1979 | Lundeberg |
| 4,153,320 | A | | 5/1979 | Townshend |
| 4,156,554 | A | | 5/1979 | Aujla |
| 4,165,911 | A | | 8/1979 | Laudig |
| 4,168,921 | A | | 9/1979 | Blanchard |
| 4,173,385 | A | | 11/1979 | Fenn et al. |
| 4,174,875 | A | | 11/1979 | Wilson et al. |
| 4,187,481 | A | | 2/1980 | Boutros |
| 4,225,162 | A | | 9/1980 | Dola |
| 4,227,765 | A | | 10/1980 | Neumann et al. |
| 4,229,714 | A | | 10/1980 | Yu |
| 4,250,348 | A | | 2/1981 | Kitagawa |
| 4,280,749 | A | | 7/1981 | Hemmer |
| 4,285,564 | A | | 8/1981 | Spinner |
| 4,290,663 | A | | 9/1981 | Fowler et al. |
| 4,296,986 | A | | 10/1981 | Herrmann et al. |
| 4,307,926 | A | | 12/1981 | Smith |
| 4,322,121 | A | | 3/1982 | Riches et al. |
| 4,339,166 | A | | 7/1982 | Dayton |
| 4,346,958 | A | | 8/1982 | Blanchard |
| 4,354,721 | A | | 10/1982 | Luzzi |
| 4,358,174 | A | | 11/1982 | Dreyer |
| 4,373,767 | A | | 2/1983 | Cairns |
| 4,389,081 | A | | 6/1983 | Gallusser et al. |
| 4,400,050 | A | | 8/1983 | Hayward |
| 4,407,529 | A | | 10/1983 | Holman |
| 4,408,821 | A | | 10/1983 | Forney, Jr. |
| 4,408,822 | A | | 10/1983 | Nikitas |
| 4,421,377 | A | | 12/1983 | Spinner |
| 4,426,127 | A | | 1/1984 | Kubota |
| 4,444,453 | A | | 4/1984 | Kirby et al. |
| 4,452,503 | A | | 6/1984 | Forney, Jr. |
| 4,456,323 | A | | 6/1984 | Pitcher et al. |
| 4,462,653 | A | | 7/1984 | Flederbach et al. |
| 4,464,000 | A | | 8/1984 | Werth et al. |
| 4,469,386 | A | | 9/1984 | Ackerman |
| 4,470,657 | A | | 9/1984 | Deacon |
| 4,484,792 | A | | 11/1984 | Tengler et al. |
| 4,484,796 | A | | 11/1984 | Sato et al. |
| 4,506,943 | A | | 3/1985 | Drogo |
| 4,515,427 | A | | 5/1985 | Smit |
| 4,525,017 | A | | 6/1985 | Schildkraut et al. |
| 4,531,805 | A | | 7/1985 | Werth |
| 4,533,191 | A | | 8/1985 | Blackwood |
| 4,540,231 | A | | 9/1985 | Forney, Jr. |
| RE31,995 | E | | 10/1985 | Ball |
| 4,545,637 | A | | 10/1985 | Bosshard et al. |
| 4,575,274 | A | | 3/1986 | Hayward |
| 4,580,862 | A | | 4/1986 | Johnson |
| 4,580,865 | A | | 4/1986 | Fryberger |
| 4,583,811 | A | | 4/1986 | McMills |
| 4,585,289 | A | | 4/1986 | Bocher |
| 4,588,246 | A | | 5/1986 | Schildkraut et al. |
| 4,593,964 | A | | 6/1986 | Forney, Jr. et al. |
| 4,596,434 | A | | 6/1986 | Saba et al. |
| 4,596,435 | A | | 6/1986 | Bickford |
| 4,598,961 | A | | 7/1986 | Cohen |
| 4,600,263 | A | | 7/1986 | DeChamp et al. |
| 4,613,199 | A | | 9/1986 | McGeary |
| 4,614,390 | A | | 9/1986 | Baker |
| 4,616,900 | A | | 10/1986 | Cairns |
| 4,632,487 | A | | 12/1986 | Wargula |
| 4,634,213 | A | | 1/1987 | Larsson et al. |
| 4,640,572 | A | | 2/1987 | Conlon |
| 4,645,281 | A | | 2/1987 | Burger |
| 4,650,228 | A | | 3/1987 | McMills et al. |
| 4,655,159 | A | | 4/1987 | McMills |
| 4,655,534 | A | | 4/1987 | Stursa |
| 4,660,921 | A | | 4/1987 | Hauver |
| 4,668,043 | A | | 5/1987 | Saba et al. |
| 4,674,818 | A | | 6/1987 | McMills et al. |
| 4,676,577 | A | | 6/1987 | Szegda |
| 4,682,832 | A | | 7/1987 | Punako et al. |
| 4,684,201 | A | | 8/1987 | Hutter |
| 4,688,876 | A | | 8/1987 | Morelli |
| 4,688,878 | A | | 8/1987 | Cohen et al. |
| 4,691,976 | A | | 9/1987 | Cowen |
| 4,703,987 | A | | 11/1987 | Gallusser et al. |
| 4,703,988 | A | | 11/1987 | Raux et al. |
| 4,717,355 | A | | 1/1988 | Mattis |
| 4,734,050 | A | | 3/1988 | Negre et al. |
| 4,734,666 | A | | 3/1988 | Ohya et al. |
| 4,737,123 | A | | 4/1988 | Paler et al. |
| 4,738,009 | A | | 4/1988 | Down et al. |
| 4,746,305 | A | | 5/1988 | Nomura |

4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson

| | | | |
|---|---|---|---|
| 6,022,237 | A | 2/2000 | Esh |
| 6,032,358 | A | 3/2000 | Wild |
| 6,042,422 | A | 3/2000 | Youtsey |
| 6,048,229 | A | 4/2000 | Lazaro, Jr. |
| 6,053,777 | A | 4/2000 | Boyle |
| 6,089,903 | A | 7/2000 | Stafford Gray et al. |
| 6,089,912 | A | 7/2000 | Tallis et al. |
| 6,089,913 | A | 7/2000 | Holliday |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,261,126 | B1 | 7/2001 | Stirling |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| D458,904 | S | 6/2002 | Montena |
| 6,406,330 | B2 | 6/2002 | Bruce |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,676,446 | B2 | 1/2004 | Montena |
| 6,683,253 | B1 | 1/2004 | Lee |
| 6,692,285 | B2 | 2/2004 | Islam |
| 6,712,631 | B1 | 3/2004 | Youtsey |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,767,248 | B1 | 7/2004 | Hung |
| 6,786,767 | B1 | 9/2004 | Fuks et al. |
| 6,790,081 | B2 | 9/2004 | Burris et al. |
| 6,805,584 | B1 | 10/2004 | Chen |
| 6,817,896 | B2 | 11/2004 | Derenthal |
| 6,848,939 | B2 | 2/2005 | Stirling |
| 6,848,940 | B2 | 2/2005 | Montena |
| 6,884,113 | B1 | 4/2005 | Montena |
| 6,884,115 | B2 | 4/2005 | Malloy |
| 6,929,508 | B1 | 8/2005 | Holland |
| 6,939,169 | B2 | 9/2005 | Islam et al. |
| 6,971,912 | B2 | 12/2005 | Montena et al. |
| 7,029,326 | B2 | 4/2006 | Montena |
| 7,070,447 | B1 | 7/2006 | Montena |
| 7,086,897 | B2 | 8/2006 | Montena |
| 7,097,499 | B1 | 8/2006 | Purdy |
| 7,102,868 | B2 | 9/2006 | Montena |
| 7,114,990 | B2 | 10/2006 | Bence et al. |
| 7,118,416 | B2 | 10/2006 | Montena et al. |
| 7,125,283 | B1 | 10/2006 | Lin |
| 7,131,868 | B2 | 11/2006 | Montena |
| 7,147,509 | B1 | 12/2006 | Burris et al. |
| 7,156,696 | B1 | 1/2007 | Montena |
| 7,161,785 | B2 | 1/2007 | Chawgo |
| 7,229,303 | B2 | 6/2007 | Vermoesen et al. |
| 7,252,546 | B1 | 8/2007 | Holland |
| 7,255,598 | B2 | 8/2007 | Montena et al. |
| 7,299,550 | B2 | 11/2007 | Montena |
| 7,393,245 | B2 | 7/2008 | Palinkas et al. |
| 7,452,239 | B2 | 11/2008 | Montena |
| 7,476,127 | B1 | 1/2009 | Wei |
| 7,479,035 | B2 | 1/2009 | Bence et al. |
| 7,497,729 | B1 | 3/2009 | Wei |
| 7,507,117 | B2 | 3/2009 | Amidon |
| 7,544,094 | B1 | 6/2009 | Paglia et al. |
| 7,566,236 | B2 | 7/2009 | Malloy et al. |
| 7,607,942 | B1 | 10/2009 | Van Swearingen |
| 7,674,132 | B1 | 3/2010 | Chen |
| 7,682,177 | B2 | 3/2010 | Berthet |
| 7,727,011 | B2 | 6/2010 | Montena et al. |
| 7,753,705 | B2 | 7/2010 | Montena |
| 7,794,275 | B2 | 9/2010 | Rodrigues |
| 7,806,725 | B1 | 10/2010 | Chen |
| 7,811,133 | B2 | 10/2010 | Gray |
| 7,824,216 | B2 | 11/2010 | Purdy |
| 7,828,595 | B2 | 11/2010 | Mathews |
| 7,833,053 | B2 | 11/2010 | Mathews |
| 7,845,976 | B2 | 12/2010 | Mathews |
| 7,845,978 | B1 | 12/2010 | Chen |
| 7,850,487 | B1 | 12/2010 | Wei |
| 7,857,661 | B1 | 12/2010 | Islam |
| 7,892,005 | B2 | 2/2011 | Haube |
| 7,892,024 | B1 | 2/2011 | Chen |
| 7,927,135 | B1 | 4/2011 | Wlos |
| 7,950,958 | B2 | 5/2011 | Mathews |
| 2002/0013088 | A1 | 1/2002 | Rodrigues et al. |
| 2002/0038720 | A1 | 4/2002 | Kai et al. |
| 2003/0214370 | A1 | 11/2003 | Allison et al. |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2006/0110977 | A1 | 5/2006 | Matthews |
| 2006/0154519 | A1 | 7/2006 | Montena |
| 2007/0026734 | A1 | 2/2007 | Bence et al. |
| 2008/0102696 | A1 | 5/2008 | Montena |
| 2009/0029590 | A1 | 1/2009 | Sykes et al. |
| 2009/0098770 | A1 | 4/2009 | Bence et al. |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy |
| 2011/0021072 | A1 | 1/2011 | Purdy |
| 2011/0053413 | A1 | 3/2011 | Mathews |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | C | 10/1888 |
| DE | 1117687 | B | 11/1961 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 67738 | A2 | 1/1986 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |

| | | | |
|---|---|---|---|
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 5462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 3280369 | B2 | 5/2002 |
| KR | 100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |

OTHER PUBLICATIONS

U.S. Appl. No. 13/018,727, filed Feb. 1, 2011.
U.S. Appl. No. 12/906,276, filed Oct. 18, 2010.

* cited by examiner

CONNECTOR HAVING ELECTRICAL CONTINUITY ABOUT AN INNER DIELECTRIC AND METHOD OF USE THEREOF

BACKGROUND

1. Technical Field

This invention relates generally to the field of connectors for coaxial cables. More particularly, this invention provides for a coaxial cable connector comprising at least one conductive member and a method of use thereof.

2. Related Art

Broadband communications have become an increasingly prevalent form of electromagnetic information exchange and coaxial cables are common conduits for transmission of broadband communications. Connectors for coaxial cables are typically connected onto complementary interface ports to electrically integrate coaxial cables to various electronic devices. In addition, connectors are often utilized to connect coaxial cables to various communications modifying equipment such as signal splitters, cable line extenders and cable network modules.

To help prevent the introduction of electromagnetic interference, coaxial cables are provided with an outer conductive shield. In an attempt to further screen ingress of environmental noise, typical connectors are generally configured to contact with and electrically extend the conductive shield of attached coaxial cables. Moreover, electromagnetic noise can be problematic when it is introduced via the connective juncture between an interface port and a connector. Such problematic noise interference is disruptive where an electromagnetic buffer is not provided by an adequate electrical and/or physical interface between the port and the connector. Weathering also creates interference problems when metallic components corrode, deteriorate or become galvanically incompatible thereby resulting in intermittent contact and poor electromagnetic shielding.

Accordingly, there is a need in the field of coaxial cable connectors for an improved connector design.

SUMMARY

The present invention provides an apparatus for use with coaxial cable connections that offers improved reliability.

A first general aspect of the invention provides A connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising: a connector body attached to a post, wherein the post has a first end and a second end, the first end configured to be inserted into an end of the coaxial cable around the foil layer encompassing the dielectric and under the conductive grounding shield thereof; a rotatable coupling element attached to the post; and a conductive member positioned along an inner surface of the post facilitating continuous electrical communication between the foil layer and the post, when the first end of the post is inserted into the end of the coaxial cable around the foil layer encompassing the dielectric and under the conductive grounding shield thereof.

A second general aspect of the invention provides a connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising: a connector body attached to the post wherein the connector body includes a first end and a second end, the first end configured to deformably compress against and seal a received coaxial cable; a rotatable coupling element attached to the post; and a conductive member located along an inner surface of a post, wherein the conductive member facilitates the grounding of the coaxial cable by electrically coupling the foil layer to the post.

A third general aspect of the invention provides a connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising: a connector body, having a first end and a second end, the first end configured to deformably compress against and seal a received coaxial cable; a post, attached to the connector body, wherein the post includes a first end and a second end, the first end configured to be inserted into an end of the coaxial cable around the foil layer encompassing the dielectric and under the conductive grounding shield thereof; a port coupling element, attached to the post; and a plurality of conductive members, wherein at least one of the plurality of conductive members is positioned along an inner surface of the post, and further wherein the plurality of conductive members helps complete a shield preventing ingress of electromagnetic noise into the connector and facilitates grounding of the coaxial cable.

A fourth general aspect of the invention provides a connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising: a connector body having a first end and a second end, the first end configured to deformably compress against and seal a received coaxial cable; a post attached to the connector body, wherein the post includes a first end and a second end, the first end configured to be inserted into an end of the coaxial cable around the foil layer encompassing the dielectric and under the conductive grounding shield thereof; a port coupling element attached to the post; and means for electrically coupling the post and the foil layer, thereby establishing electrical continuity about the dielectric.

A fifth general aspect of the invention provides a method for grounding a coaxial cable through a connector, the coaxial cable having a center conductor surrounded by a dielectric, the dielectric being surrounded by a foil layer, the foil layer being surrounded by a conductive grounding shield, the conductive grounding shield being surrounded by a protective outer jacket, the method comprising: providing a coaxial cable connector having a post positioned within a connector body of the coaxial cable connector; positioning a first conductive member on an inner surface of the post, wherein the first conductive member contacts both the foil layer and the post establishing and maintaining electrical continuity; fixedly attaching the coaxial cable to the connector; and connecting the connector onto an interface port so that the first conductive member facilitates grounding through the connector.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION

Figure 1:
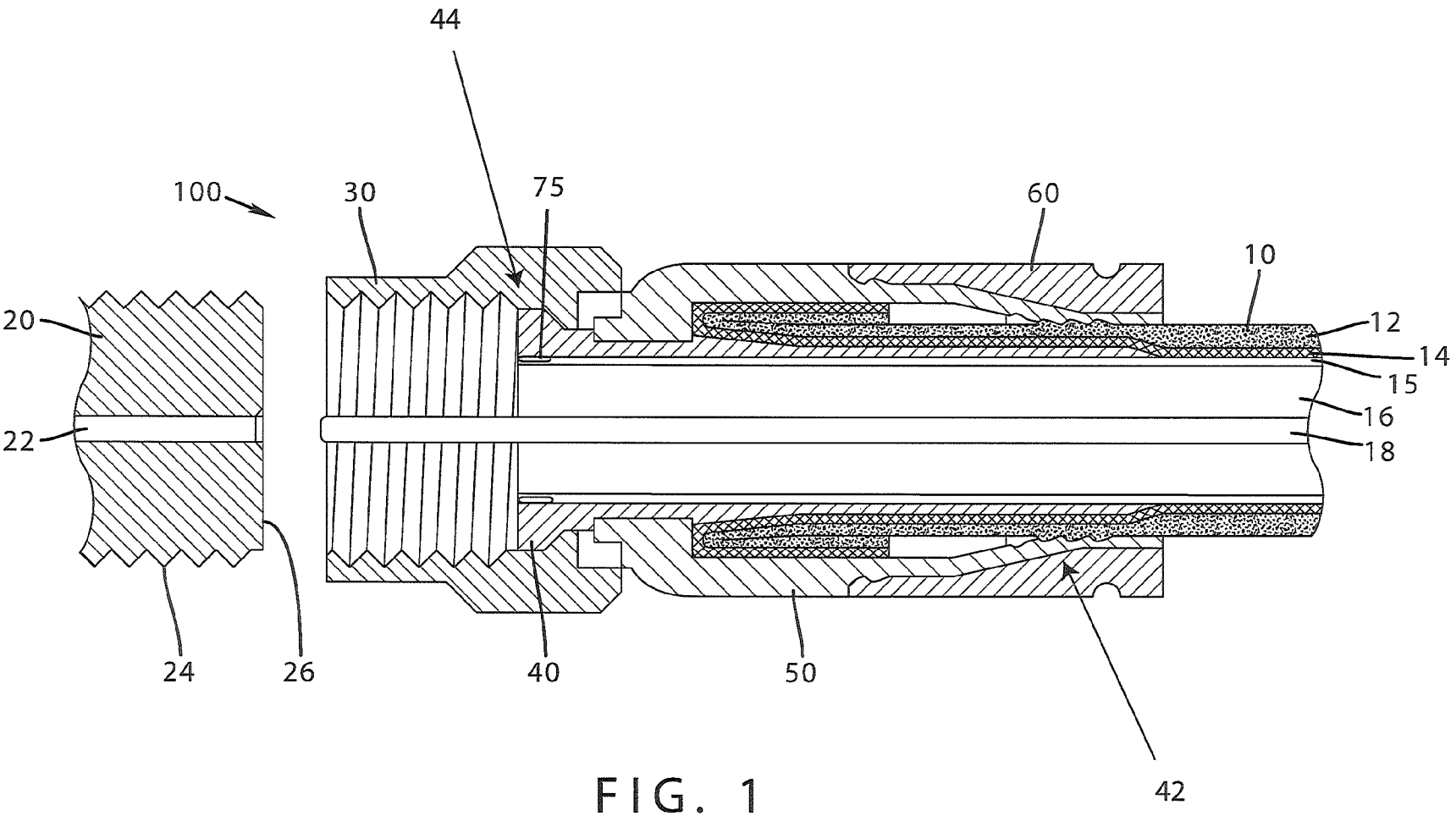
FIG. 1 depicts a sectional side view of an embodiment of a connector, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts one embodiment of a connector 100. The connector 100 may include a coaxial cable 10 having a protective outer jacket 12, a conductive grounding shield 14, a conductive foil layer 15, an interior dielectric 16, and a center conductor 18. The coaxial cable 10 may be prepared as further embodied in FIG. 1B by removing the protective outer jacket 12 and drawing back the conductive grounding shield 14 to expose a portion of the conductive foil layer 15 encompassing an interior dielectric 16. Further preparation of the embodied coaxial cable 10 may include stripping the dielectric 16 and conductive foil layer 15 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise several conductive strands formed in a continuous braid around the conductive foil layer 15 surrounding the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to preventingress of environmental noise that may disrupt broadband communications. Furthermore, there may be more than one grounding shield 14, such as a tri-shield or quad shield cable, and there may also be flooding compounds protecting the shield 14. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, conductive foil layer 15, interior dielectric 16 and/or center conductor 18 may vary based upon generally recognized parameters corresponding to broadband communication standards and/or equipment.

The conductive foil layer 15 may comprise a layer of foil wrapped or otherwise positioned around the dielectric 16, thus the conductive foil layer 15 may surround and/or encompass the dielectric 16. For instance, the conductive foil layer 15 may be positioned between the dielectric 16 and the shield 14. In one embodiment, the conductive foil layer 15 may be bonded to the dielectric 16. In another embodiment, the conductive foil layer 15 may be generally wrapped around the dielectric 16. The conductive foil layer 15 may provide a continuous uniform outer conductor for maintaining the coaxial condition of the coaxial cable 10 along its axial length. The coaxial cable 10 having, inter alia, a conductive foil layer 15 may be manufactured in thousands of feet of lengths. Furthermore, the conductive foil layer 15 may be manufactured to a nominal outside diameter with a plus minus tolerance on the diameter, and may be a wider range than what may normally be achievable with machined, molded, or cast components. The outside diameter of the conductive foil layer 15 may vary in dimension down the length of the cable 10, thus its size may be unpredictable at any point along the cable 10. Due to this unpredictability, the contact between the post 40 and the conductive foil layer 15 may not be sufficient or adequate for conductivity or continuity. A conductive member 75 may be placed inside or along an inner surface of the post 40 to allow continuity and/or continuous physical and electrical contact or communication with the conductive foil layer 15. Continuous conductive and electrical communication or contact between the post 40 and the conductive foil layer 15 may be established by the physical and electrical contact between the conductive foil layer 15 and the conductive member 75, wherein the conductive member 75 is in physical and electrical communication or contact with the post 40.

Referring further to FIG. 1, the connector 100 may also include a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. However, various embodiments may employ a smooth surface, as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and height of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a connector 100. For example, the threaded exterior surface may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

With continued reference to FIG. 1, an embodiment of the connector 100 may further comprise a threaded nut 30, a post 40, a connector body 50, a fastener member 60, and a conductive member 75. The conductive member 75 should be formed of a conductive material. Such materials may include, but are not limited to conductive polymers, conductive plastics, conductive elastomers, conductive elastomeric mixtures, composite materials having conductive properties, metal, soft metals, conductive rubber, and/or the like and/or any operable combination thereof. The conductive member 75 may be a resilient, rigid, semi-rigid, flexible, or elastic, and may have a circular, rectangular, square, or any appropriate geometrically dimensioned cross-section forming a ring-shaped member. For example, the conductive member 75 may comprise a substantially circinate torus or toroid structure, or other ring-like structure. The conductive member 75 may be placed inside or along the inside of the post 40 to allow inner dielectric continuity with the conductive foil layer 15. This may be true for all cases of tolerance of the cable 10 as well as the inside of the post 40. In one embodiment, the conductive member 75 may be press-fit onto the inner surface of the post 40, proximate the second end 44 of the post 40, such that the diameter of the conductive member 75 may be slightly smaller than the diameter of the second end 44 of the post 40. For example, the conductive member 75 may be press-fit, attached, fastened, fixed, adhered, and/or coupled to the inner wall of the post 40 proximate the second end 44, such that the conductive member fits snugly when placed proximate the second end 44 of the post 40. Those skilled in the art would appreciate that the conductive member 75 may be fabricated by extruding, coating, molding, injecting, cutting, turning, elastomeric batch processing, vulcanizing, mixing, stamping, casting, and/or the like and/or any combination thereof in order to provide efficient production of the component.

Furthermore, the conductive member 75 need not be a ring-shaped member and extend 360° around the inner surface of the post 40. For example, the conductive member 75 may be placed along an inner surface of the post 40, at one specific location, wherein it does not extend 360° around the inner surface of the post 40. As long as the conductive member 75 is positioned between and physically contacts the conductive foil layer 15 and the post 40, physical and electrical communication may be established and maintained. In one embodiment, the conductive member 75 may be positioned along the inner surface of the post 40, wherein the shape of the conductive member 75 may conform to the curvature of the post 40 forming an arc-shaped member, or semi-circle. Alternatively, the conductive member 75 may be a rectangular or polygonal structure positioned along an inner surface of the post 40. The conductive member 75 may have a circular, rectangular, or square cross section. Thus, the contact between the conductive member 75 and the post 40 at one specific location may establish and maintain electrical and physical continuity. In another embodiment, there may be a conductive member 75 placed at more than one location along the inner surface of the post 40. For instance, a conductive member 75 may be located along the inner surface of the post 40 proximate the second end 42, and a second conductive member 75 may be placed along the inner surface of the post proximate the first end 41. Additionally, a single conductive member 75 may be placed along the inner surface of the post 40 proximate the first end 41, or a single conductive member 75 may be placed along the inner surface of the post 40 proximate the second end 42.

The conductive member 75 may be in physical and electrical communication or contact with the conductive foil layer 15 which may result in electrical continuity about an inner dielectric 16 for a connector 100, such as an F connector. For example, when the dielectric 16 and center conductor 18 are proximate the second end 44 of the post 40, the conductive foil layer 15 contacts the conductive member 75. The physical contact may be sufficient and adequate because the coaxial cable 10 may be radially compressed proximate the second end 44 of the post, thereby strengthening or tightening the contact between the conductive foil layer 15 and the conductive member 75. The physical contact may be strengthened because a radial compressive force applied to the coaxial cable 10 may cause the post 40 to apply or exert a force onto the dielectric 16. The conductive member 75 and conductive foil layer 15 positioned between the post 40 and the dielectric 16 may be compressed together, thereby strengthening the physical contact between them, which may ensure an adequate and continuous physical and electrical contact or communication between them. The physical and electrical communication or contact between the conductive foil layer 15 and the conductive member 75 may transfer the electricity or current from the conductive foil layer 15 to the post 40, which may ground the coaxial cable 10 when the post 40 is in electrical or conductive communication with the coaxial cable interface port 20. Furthermore, the outer electromagnetic shield extending through the conductive foil layer 15 may be prevent electromagnetic noise from reaching the center conductor 18 because the conductive foil layer 15 continuously electrically contacts the conductive member 75, and the conductive member 75 is in physical and electrical contact or communication with the post 40. Thus, the post 40 may be in continuous electrical and conductive communication with the conductive foil layer 15, providing electrical continuity about an inner dielectric 16 for a connector 100.

Figure 1A:
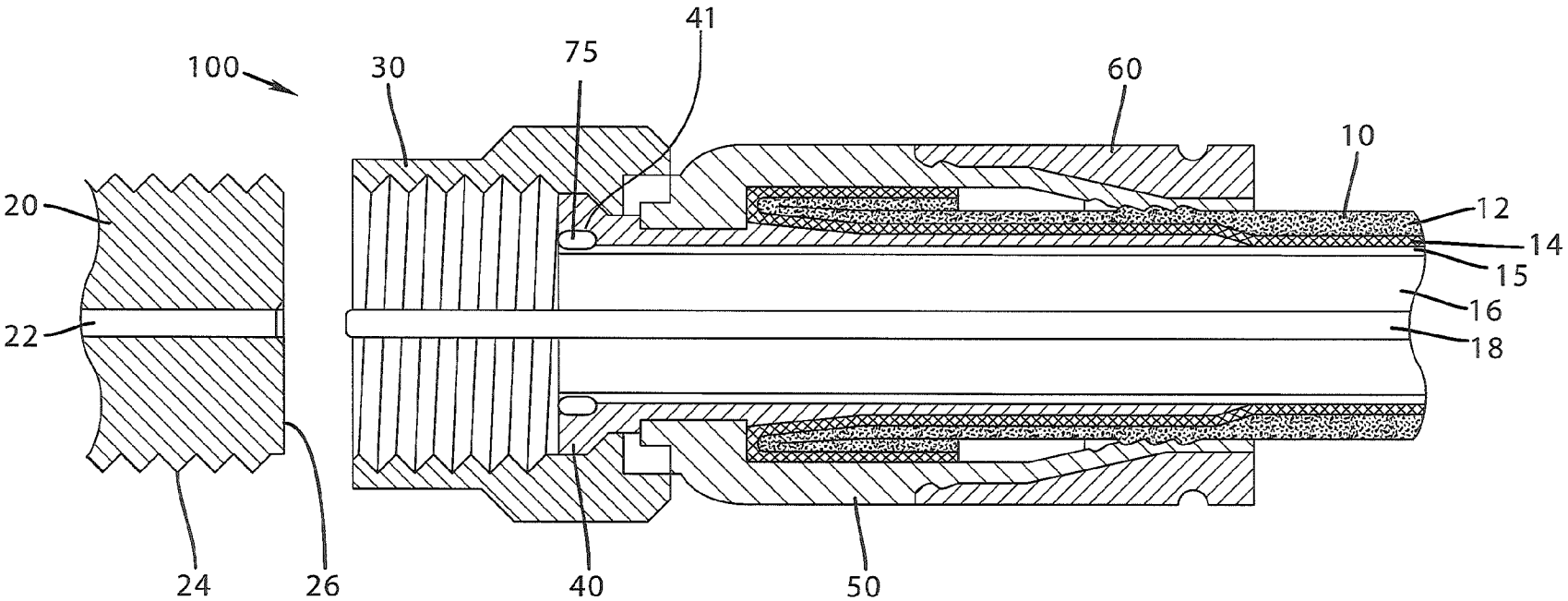
FIG. 1A depicts a sectional side view of an embodiment of a connector having a post notch, in accordance with the present invention.
Figure 1B:
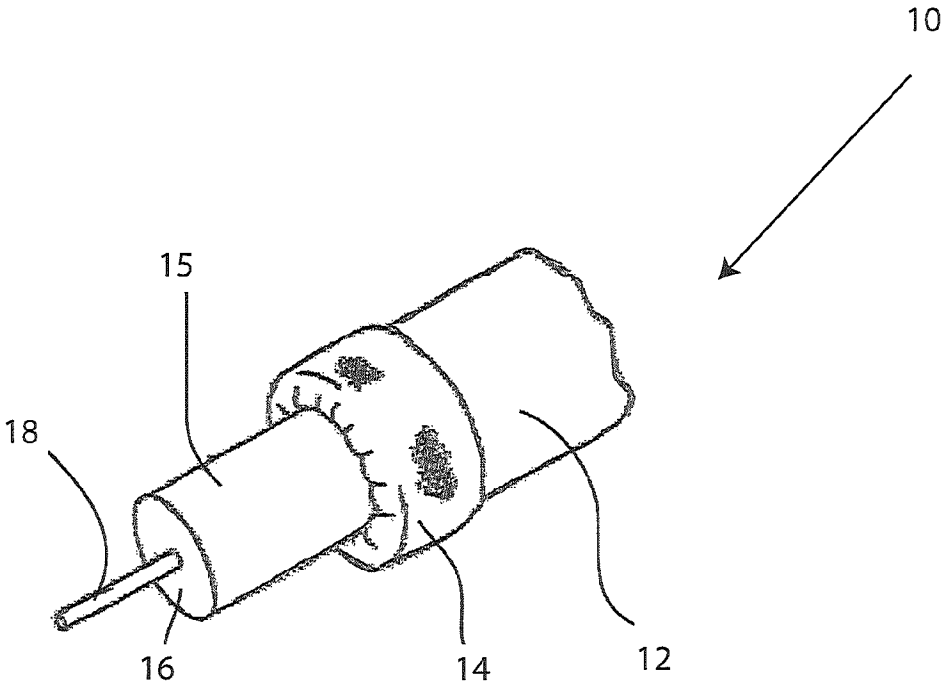
FIG. 1B depicts a perspective view of an embodiment of a prepared coaxial cable, in accordance with the present invention.

FIG. 1A depicts an embodiment of the connector 100 which may comprise a threaded nut 30, a post 40 having a post notch 41, a connector body 50, a fastener member 60, and a conductive member 75 fitting within the post notch 41. The conductive member 75 may be a resilient, rigid, semi-rigid, flexible, or elastic, and may have a circular, rectangular, square, or any appropriate geometrically dimensioned cross section forming a ring-shaped member. For example, the conductive member 75 may comprise a substantially circinate torus or toroid structure, or other ring-like structure. The conductive member 75 may also form an arc-shape member that may not extend 360° around the inner surface of the post 40. Alternatively, the conductive member 75 may be a rectangular or polygonal structure positioned along an inner surface of the post 40. The conductive member 75 may be placed inside or along the inside of the post 40 to allow continuity with the conductive foil layer 15 in all cases of tolerance of the cable 10 as well as the inside of the post 40. However, instead of being press-fit within the inner surface of the post 40, all or a portion of the conductive member 75 may reside in the post notch 41. For example, a portion, or a first surface, of the conductive member 75 may reside within the post notch 41, while the other portion, or second surface, may maintain direct and continuous contact with the conductive foil layer 15 providing inner dielectric continuity for a connector 100. Additionally, a post 40 may have more than one post notch 41, each post notch 41 accommodating a conductive member 75. Thus, there may be multiple conductive members 75 present in an operable connector 100.

Figure 2:
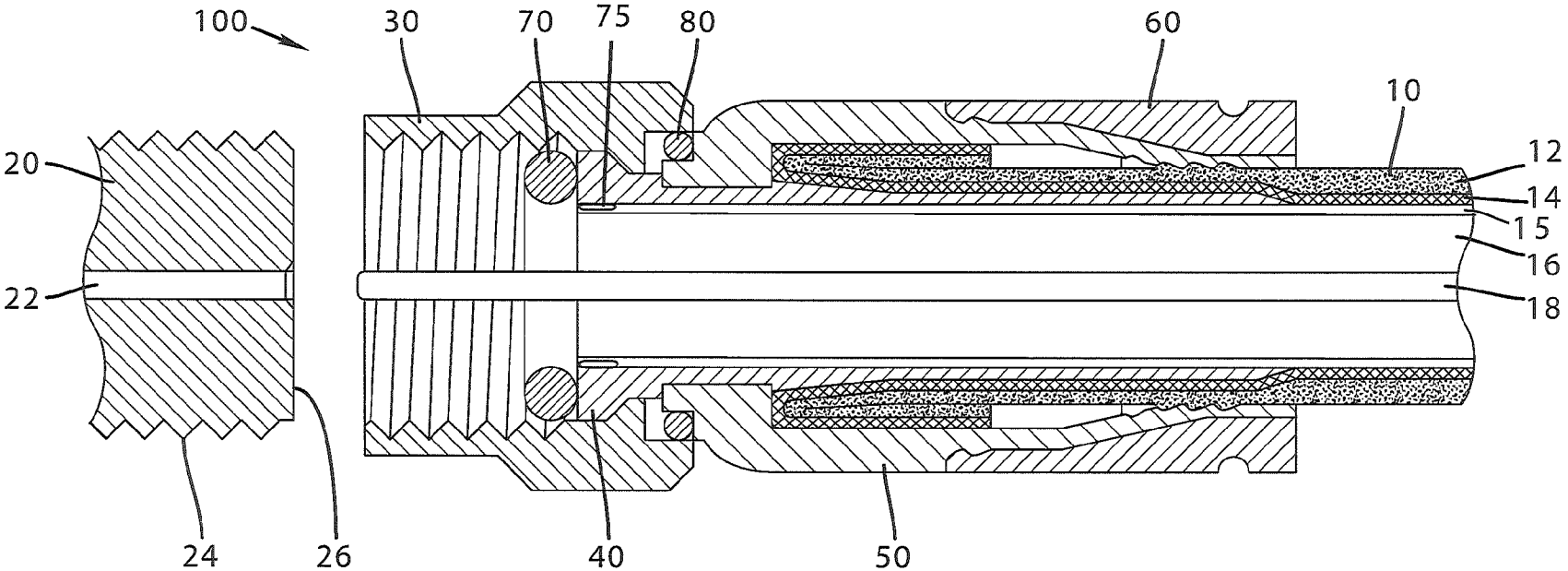
FIG. 2 depicts a sectional side view of an embodiment of a connector having more than one conductive member, in accordance with the present invention.
Figure 2A:
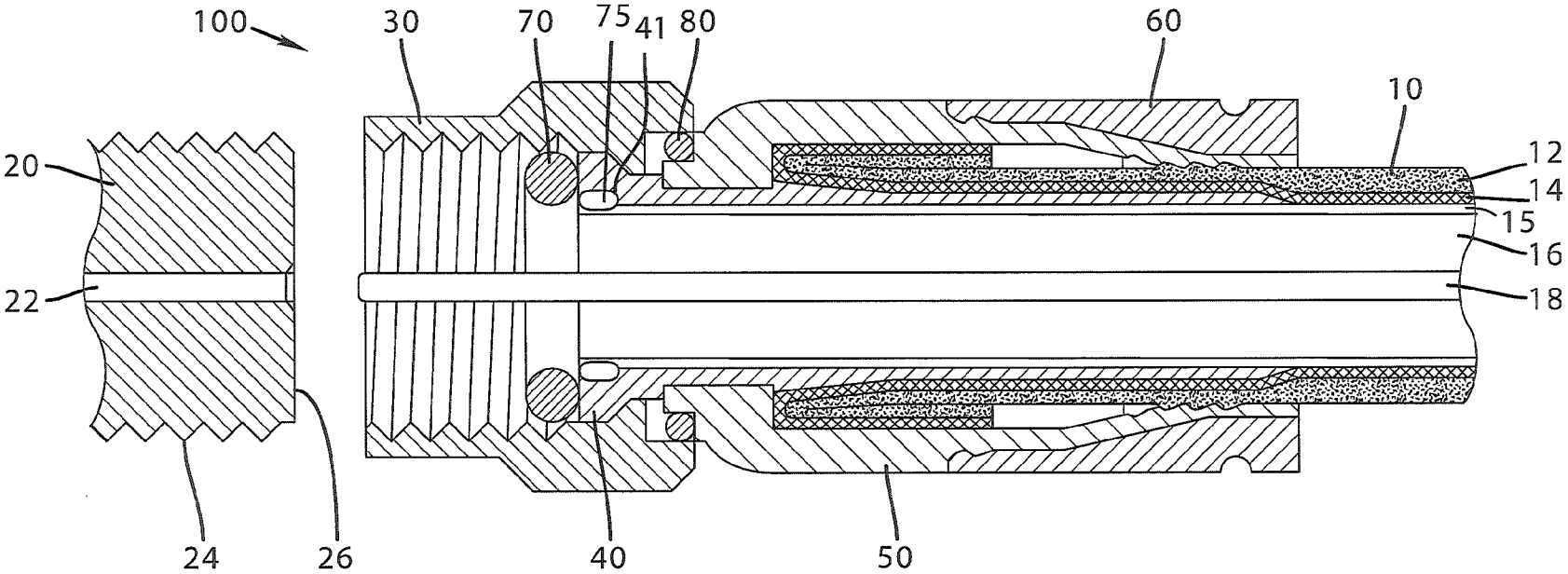
FIG. 2A depicts a sectional side view of an embodiment of a connector with a post notch, having more than one conductive member, in accordance with the present invention.

FIG. 2 depicts an embodiment of the connector 100 which may further comprise a threaded nut 30, a post 40, a connector body 50, a fastener member 60, a conductive member 75, a mating edge conductive member such as O-ring 70, and/or a connector body conductive member, such as O-ring 80, and means for conductively sealing and electrically coupling the connector body 50 and threaded nut 30. The means for conductively sealing and electrically coupling the connector body 50 and threaded nut 30 may be the employment of the connector body conductive member 80 positioned in a location so as to make a physical seal and effectuate electrical contact between the connector body 50 and threaded nut 30. The conductive member 75 may be press-fit within the inside of the post 40 or may reside in the post notch 41 as shown in FIG. 2A.

Figure 3:
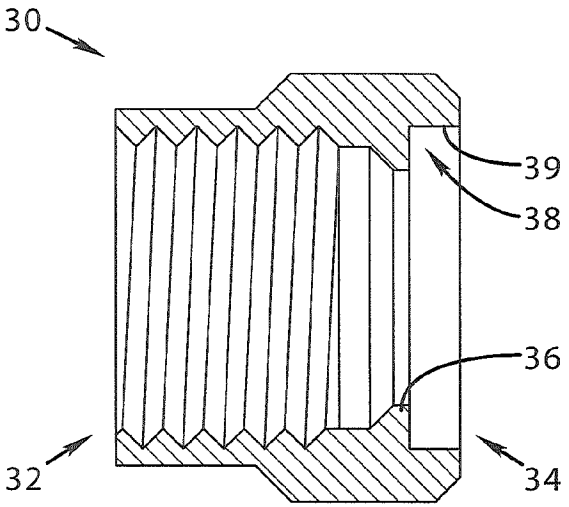
FIG. 3 depicts a sectional side view of an embodiment of a threaded nut, in accordance with the present invention.

With additional reference to the drawings, FIG. 3 depicts a sectional side view of an embodiment of a threaded nut 30 having a first end 32 and opposing second end 34. The threaded nut may be rotatably secured to the post 40 to allow for rotational movement about the post. The threaded nut 30 may comprise an internal lip 36 located proximate the second end 34 and configured to hinder axial movement of the post 40 (shown in FIG. 4). Furthermore, the threaded nut 30 may comprise a cavity 38 extending axially from the edge of second end 34 and partial defined and bounded by the internal lip 36. The cavity 38 may also be partially defined and bounded by an outer internal wall 39. The threaded nut 30 may be formed of conductive materials facilitating grounding through the nut. Accordingly the nut 30 may be configured to extend an electromagnetic buffer by electrically contacting conductive surfaces of an interface port 20 when a connector 100 (shown in FIG. 1) is advanced onto the port 20. In addition, the threaded nut 30 may be formed of non-conductive material and function only to physically secure and advance a connector 100 onto an interface port 20. Moreover, the threaded nut 30 may be formed of both conductive and non-conductive materials. For example the internal lip 36 may be formed of a polymer, while the remainder of the nut 30 may be comprised of a metal or other conductive material. In addition, the threaded nut 30 may be formed of metals or polymers or other materials that would facilitate a rigidly formed body. Manufacture of the threaded nut 30 may include casting, extruding, cutting, turning, tapping, drilling, injection molding, blow molding, or other fabrication methods that may provide efficient production of the component. Those in the art should appreciate the various embodiments of the nut 30 may also comprise a coupler member having no threads, but being dimensioned for operable connection to a corresponding to an interface port, such as interface port 20.

Figure 4:
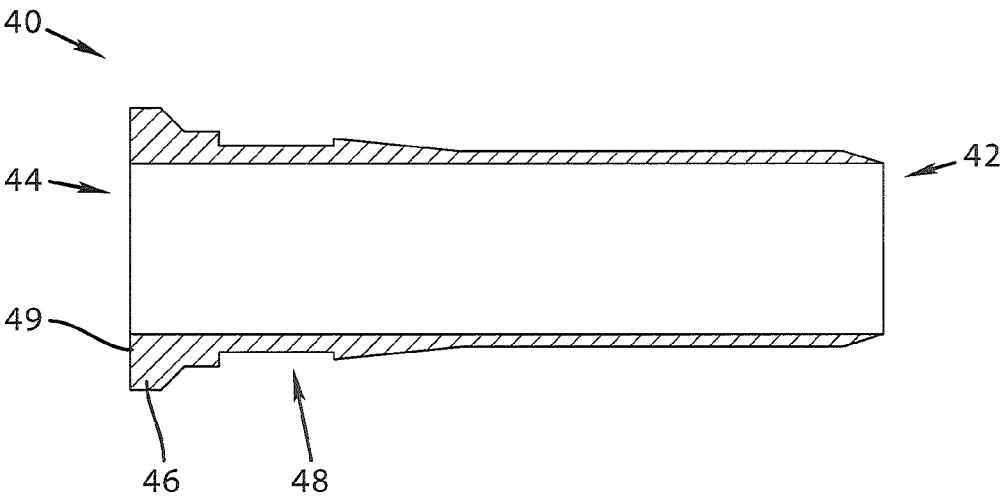
FIG. 4 depicts a sectional side view of an embodiment of a post, in accordance with the present invention.

With further reference to the drawings, FIG. 4 depicts a sectional side view of an embodiment of a post 40 in accordance with the present invention. The post 40 may comprise a first end 42 and opposing second end 44. Furthermore, the post 40 may comprise a flange 46 operably configured to contact internal lip 36 of threaded nut 30 (shown in FIG. 2) thereby facilitating the prevention of axial movement of the post beyond the contacted internal lip 36. Further still, an embodiment of the post 40 may include a surface feature 48 such as a shallow recess, detent, cut, slot, or trough. Additionally, the post 40 may include a mating edge 49. The mating edge 49 may be configured to make physical and/or electrical contact with an interface port 20 or mating edge member (shown in FIG. 1) or O-ring 70 (shown in FIG. 8). The post 40 should be formed such that portions of a prepared coaxial cable 10 including the dielectric 16, conductive foil layer 15, and center conductor 18 (shown in FIG. 1) may pass axially into the first end 42 and/or through the body of the post 40. Moreover, the post 40 should be dimensioned such that the post 40 may be inserted into an end of the prepared coaxial cable 10, around the conductive foil layer surrounding the dielectric 16, and under the protective outer jacket 12 and conductive grounding shield 14. Accordingly, where an embodiment of the post 40 may be inserted into an end of the prepared coaxial cable 10 under the drawn back conductive grounding shield 14 substantial physical and/or electrical contact with the shield 14 may be accomplished thereby facilitating grounding through the post 40. The post 40 may be formed of metals or other conductive materials that would facilitate a rigidly formed body. In addition, the post 40 may also be formed of non-conductive materials such as polymers or composites that facilitate a rigidly formed body. In further addition, the post may be formed of a combination of both conductive and non-conductive materials. For example, a metal coating or layer may be applied to a polymer of other non-conductive material. Manufacture of the post 40 may include casting, extruding, cutting, turning, drilling, injection molding, spraying, blow molding, or other fabrication methods that may provide efficient production of the component.

Figure 4A:
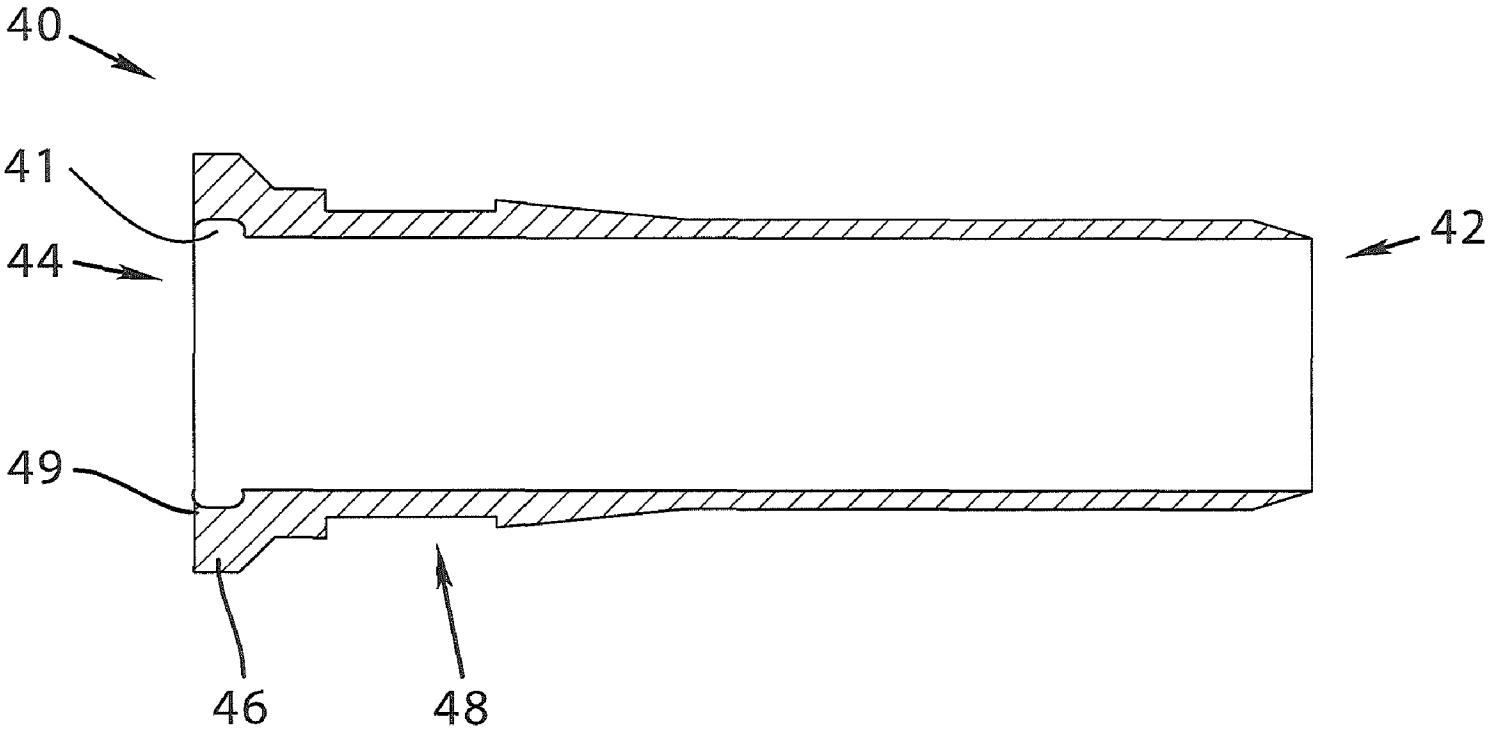
FIG. 4A depicts a sectional side view of an embodiment of a post having a post notch, in accordance with the present invention.

FIG. 4A depicts an embodiment of post 40 having a first end 42 and a second end 44, and a post notch 41 proximate the second end 44. It should be understood that there may be more than one post notch 41 along the inner surface of the post 40, or there may be a single post notch 41 proximate the first end 42, a single post notch 41 proximate the second end 44, or a single post notch 41 positioned somewhere between the first end 42 and the second end 44. The post notch 41 may be a notch, opening, indent, trough, recess, detent, or slot that may accommodate a portion of the conductive member 75. The post notch 41 may be curvilinear to accommodate a curvilinear conductive member 75 or the post notch 41 may form 90° angles to accommodate a square or rectangular cross-sectional conductive member 75. The post notch 41 may extend 360° around the inside of the post 40. For example, a portion, or first surface, of the conductive member 75 in the shape of an O-ring may fit within in the post notch 41, while the other portion, or second surface, maintains direct physical and electrical contact with the conductive foil layer 15. Alternatively, the post notch 41 may not extend 360° around the inner surface of the post 40. A post notch 41 may simply be a cut-out, groove, opening, hole, detent, and the like, that does not continue the entire circumferential length of the diameter of the post 40.

Figure 5:
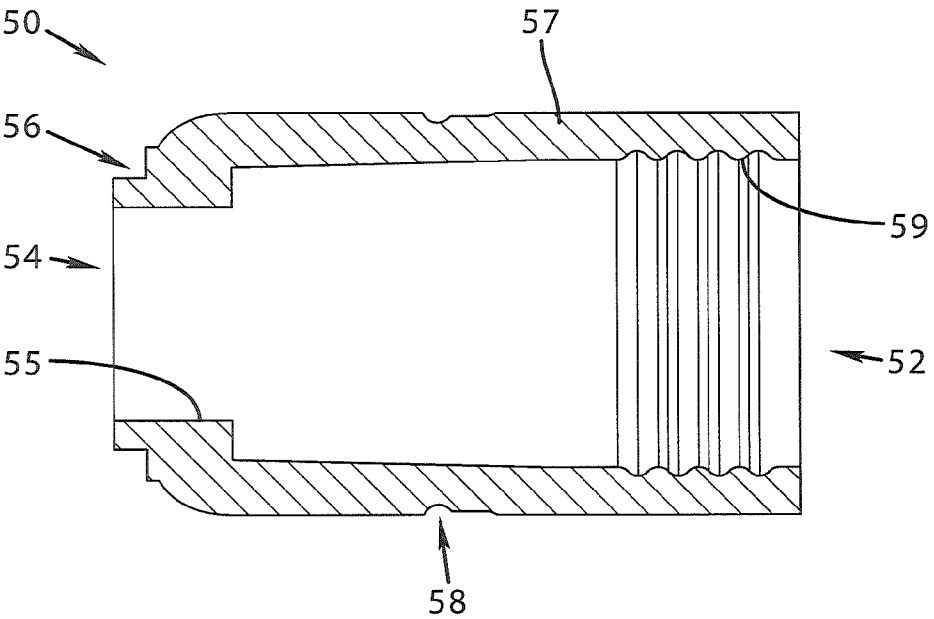
FIG. 5 depicts a sectional side view of an embodiment of a connector body, in accordance with the present invention.

With continued reference to the drawings, FIG. 5 depicts a sectional side view of a connector body 50. The connector body 50 may comprise a first end 52 and opposing second end 54. Moreover, the connector body may include an internal annular lip 55 configured to mate and achieve purchase with the surface feature 48 of post 40 (shown in FIG. 4). In addition, the connector body 50 may include an outer annular recess 56 located proximate the second end 54. Furthermore, the connector body may include a semi-rigid, yet compliant outer surface 57, wherein the surface 57 may include an annular detent 58. The outer surface 57 may be configured to form an annular seal when the first end 52 is deformably compressed against a received coaxial cable 10 by a fastener member 60 (shown in FIG. 1). Further still, the connector body 50 may include internal surface features 59, such as annular serrations formed proximate the first end 52 of the connector body 50 and configured to enhance frictional restraint and gripping of an inserted and received coaxial cable 10. The connector body 50 may be formed of materials such as, polymers, bendable metals or composite materials that facilitate a semi-rigid, yet compliant outer surface 57. Further, the connector body 50 may be formed of conductive or non-conductive materials or a combination thereof. Manufacture of the connector body 50 may include casting, extruding, cutting, turning, drilling, injection molding, spraying, blow molding, or other fabrication methods that may provide efficient production of the component.

Figure 6:
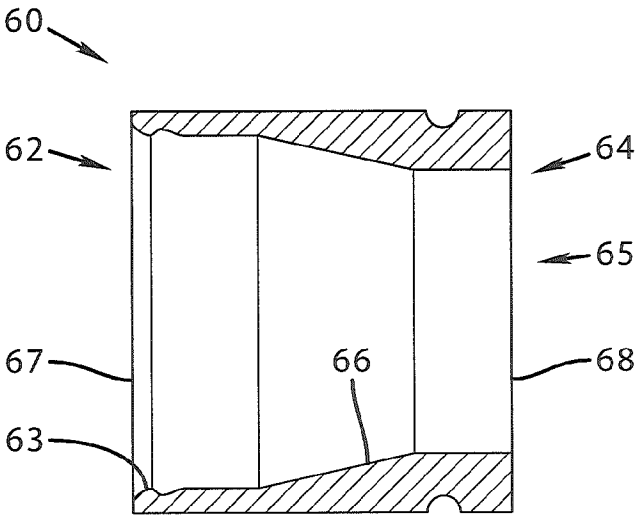
FIG. 6 depicts a sectional side view of an embodiment of a fastener member, in accordance with the present invention.

Referring further to the drawings, FIG. 6 depicts a sectional side view of an embodiment of a fastener member 60 in accordance with the present invention. The fastener member 60 may have a first end 62 and opposing second end 64. In addition, the fastener member 60 may include an internal annular protrusion 63 located proximate the first end 62 of the fastener member 60 and configured to mate and achieve purchase with the annular detent 58 on the outer surface 57 of connector body 50 (shown in FIG. 5). Moreover, the fastener member 60 may comprise a central passageway 65 defined between the first end 62 and second end 64 and extending axially through the fastener member 60. The central passageway 65 may comprise a ramped surface 66 which may be positioned between a first opening or inner bore 67 having a first diameter positioned proximate with the first end 62 of the fastener member 60 and a second opening or inner bore 68 having a second diameter positioned proximate with the second end 64 of the fastener member 60. The ramped surface 66 may act to deformably compress the inner surface 57 of a connector body 50 when the fastener member 60 is operated to secure a coaxial cable 10 (shown in FIG. 1). Additionally, the fastener member 60 may comprise an exterior surface feature 69 positioned proximate with the second end 64 of the fastener member 60. The surface feature 69 may facilitate gripping of the fastener member 60 during operation of the connector 100 (see FIG. 1). Although the surface feature is shown as an annular detent, it may have various shapes and sizes such as a ridge, notch, protrusion, knurling, or other friction or gripping type arrangements. It should be recognized, by those skilled in the requisite art, that the fastener member 60 may be formed of rigid materials such as metals, polymers, composites and the like. Furthermore, the fastener member 60 may be manufactured via casting, extruding, cutting, turning, drilling, injection molding, spraying, blow molding, or other fabrication methods that may provide efficient production of the component.

Figure 7:
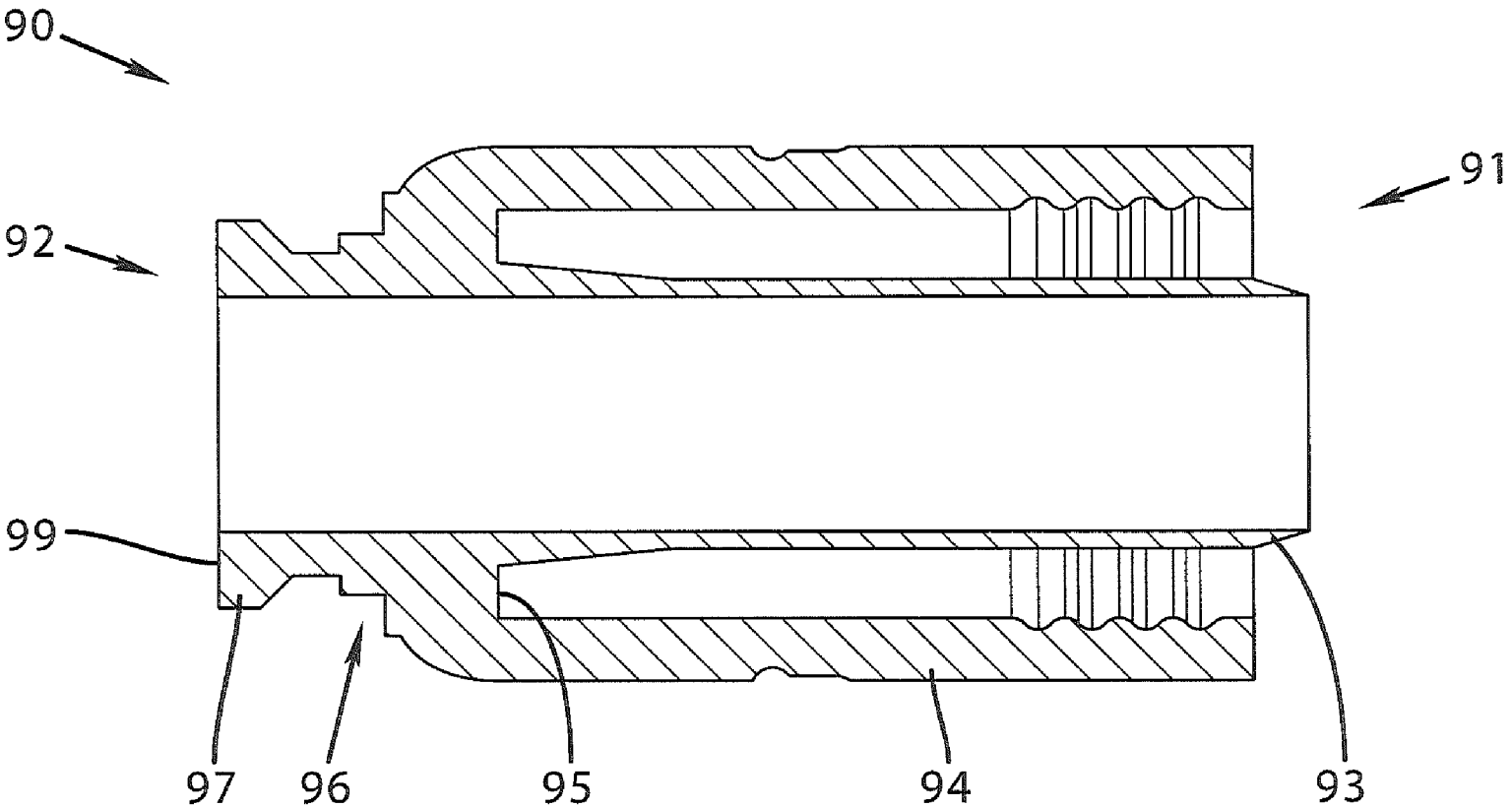
FIG. 7 depicts a sectional side view of an embodiment of a connector body having an integral post, in accordance with the present invention.

Referring still further to the drawings, FIG. 7 depicts a sectional side view of an embodiment of an integral post connector body 90 in accordance with the present invention. The integral post connector body 90 may have a first end 91 and opposing second end 92. The integral post connector body 90 physically and functionally integrates post and connector body components of an embodied connector 100 (shown in FIG. 1). Accordingly, the integral post connector body 90 includes a post member 93. The post member 93 may render connector operability similar to the functionality of post 40 (shown in FIG. 4). For example, the post member 93 of integral post connector body 90 may include a mating edge 99 configured to make physical and/or electrical contact with an interface port 20 or mating edge member or O-ring 70 (shown in FIG. 1). The post member 93 of integral should be formed such that portions of a prepared coaxial cable 10 including the dielectric 16, conductive foil layer 15, and center conductor 18 (shown in FIG. 1) may pass axially into the first end 91 and/or through the post member 93. Moreover, the post member 93 should be dimensioned such that a portion of the post member 93 may be inserted into an end of the prepared coaxial cable 10, around the dielectric 16 and conductive foil layer 15, and under the protective outer jacket 12 and conductive grounding shield 14 or shields 14. Further, the integral post connector body 90 includes a connector body surface 94. The connector body surface 94 may render connector 100 operability similar to the functionality of connector body 50 (shown in FIG. 5). Hence, inner connector body surface 94 should be semi-rigid, yet compliant. The outer connector body surface 94 may be configured to form an annular seal when compressed against a coaxial cable 10 by a fastener member 60 (shown in FIG. 1). In addition, the integral post connector body 90 may include an interior wall 95. The interior wall 95 may be configured as an unbroken surface between the post member 93 and outer connector body surface 94 of integral post connector body 90 and may provide additional contact points for a conductive grounding shield 14 of a coaxial cable 10. Furthermore, the integral post connector body 90 may include an outer recess formed proximate the second end 92. Further still, the integral post connector body 90 may comprise a flange 97 located proximate the second end 92 and operably configured to contact internal lip 36 of threaded nut 30 (shown in FIG. 3) thereby facilitating the prevention of axial movement of the integral post connector body 90 with respect to the threaded nut 30, yet still allowing rotational movement of the axially secured nut 30. The integral post connector body 90 may be formed of materials such as, polymers, bendable metals or composite materials that facilitate a semi-rigid, yet compliant outer connector body surface 94. Additionally, the integral post connector body 90 may be formed of conductive or non-conductive materials or a combination thereof. Manufacture of the integral post connector body 90 may include casting, extruding, cutting, turning, drilling, injection molding, spraying, blow molding, or other fabrication methods that may provide efficient production of the component.

Figure 7A:
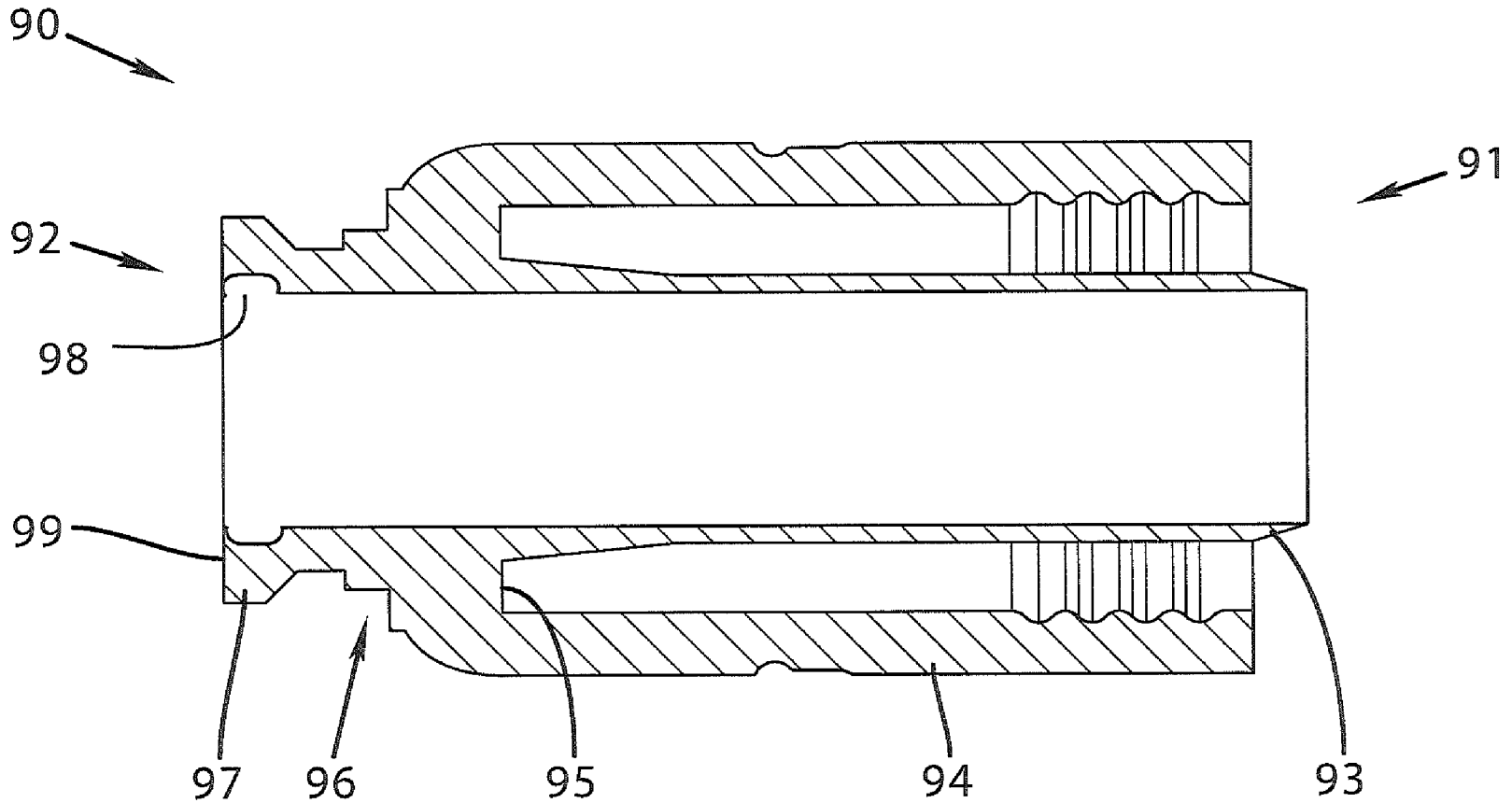
FIG. 7A depicts a sectional side view of an embodiment of a connector body having an integral post, wherein the integral post has a post notch, in accordance with the present invention.

FIG. 7A depicts an embodiment of integral post connector body 90 having a first end 91 and a second end 92, and an integral post notch 98 proximate the second end 92. The integral post notch 98 may be a notch, opening, indent, recess, detent, trough, or slot that may accommodate a portion of the conductive member 75. The integral post notch 98 may be curvilinear to accommodate a curvilinear conductive member 75 or the integral post notch 98 may form 90° angles to accommodate a square or rectangular cross-sectional conductive member 75. The integral post notch 98 may extend 360° around the inside of the integral post connector body 90, or it may not extend 360° around the inner surface of the integral post connector body 90. For example, a portion, or first surface, of the conductive member 75 in the shape of an O-ring may fit within in the integral post notch 98, while the other portion, or second surface, maintains direct contact with the conductive foil layer 15.

Figure 8:
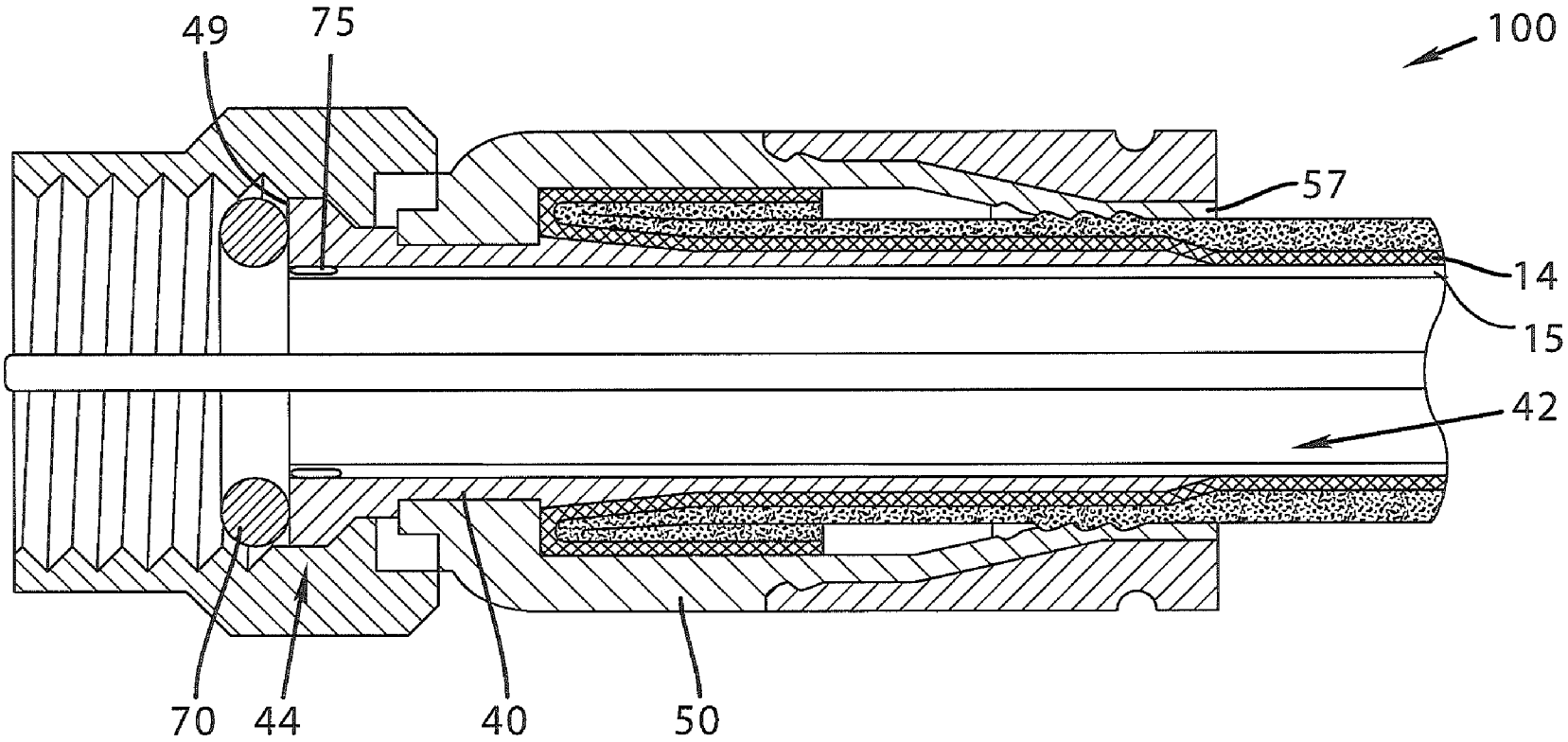
FIG. 8 depicts a sectional side view of an embodiment of a connector configured with more than one conductive member proximate a second end of a post, in accordance with the present invention.

With continued reference to the drawings, FIG. 8 depicts a sectional side view of an embodiment of a connector 100 configured with a mating edge conductive member 70 proximate a second end 44 of a post 40, and a conductive member 75 located proximate a second end 44 of the post 40, in accordance with the present invention. The mating edge conductive member 70 should be formed of a conductive material. Such materials may include, but are not limited to conductive polymers, conductive plastics, conductive elastomers, conductive elastomeric mixtures, composite materials having conductive properties, soft metals, conductive rubber, and/or the like and/or any operable combination thereof. The mating edge conductive member 70 may comprise a substantially circinate torus or toroid structure adapted to fit within the internal threaded portion of threaded nut 30 such that the mating edge conductive member 70 may make contact with and/or reside continuous with a mating edge 49 of a post 40 when operably attached to post 40 of connector 100. For example, one embodiment of the mating edge conductive member 70 may be an O-ring. The mating edge conductive member 70 may facilitate an annular seal between the threaded nut 30 and post 40 thereby providing a physical barrier to unwanted ingress of moisture and/or other environmental contaminates. Moreover, the mating edge conductive member 70 may facilitate electrical coupling of the post 40 and threaded nut 30 by extending therebetween an unbroken electrical circuit. In addition, the mating edge conductive member 70 may facilitate grounding of the connector 100, and attached coaxial cable (shown in FIG. 1), by extending the electrical connection between the post 40 and the threaded nut 30. Furthermore, the mating edge conductive member 70 may effectuate a buffer preventing ingress of electromagnetic noise between the threaded nut 30 and the post 40. The mating edge conductive member or O-ring 70 may be provided to users in an assembled position proximate the second end 44 of post 40, or users may themselves insert the mating edge conductive O-ring 70 into position prior to installation on an interface port 20 (shown in FIG. 1). Those skilled in the art would appreciate that the mating edge conductive member 70 may be fabricated by extruding, coating, molding, injecting, cutting, turning, elastomeric batch processing, vulcanizing, mixing, stamping, casting, and/or the like and/or any combination thereof in order to provide efficient production of the component.

Figure 8A:
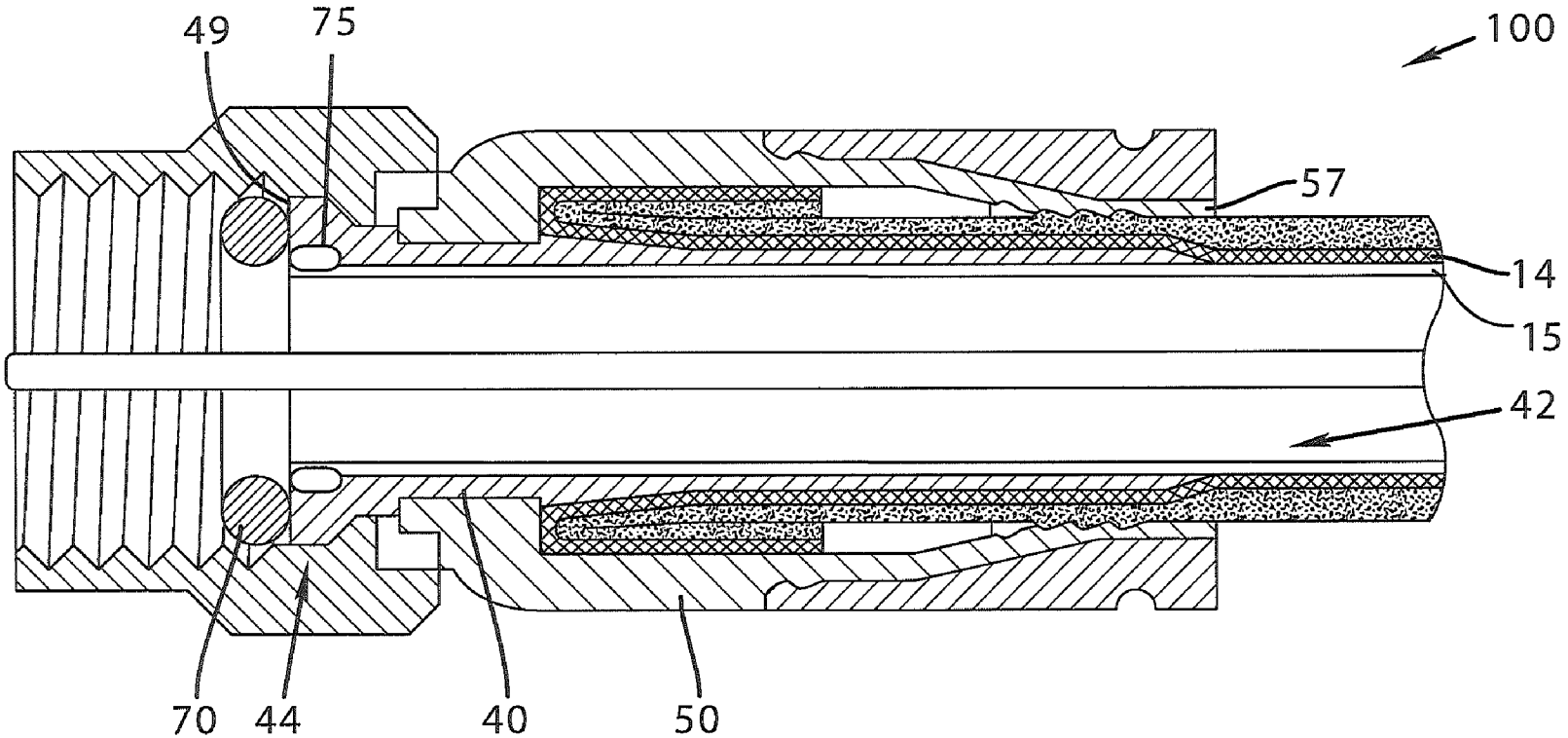
FIG. 8A depicts a sectional side view of an embodiment of a connector configured with more than one conductive member proximate a second end of a post having a post notch, in accordance with the present invention.

FIG. 8A depicts a sectional side view of an embodiment of a connector 100 configured with a mating edge conductive member 70 proximate a second end 44 of a post 40, and a conductive member 75 located proximate a second end 44 of the post 40, wherein a portion of the conductive member 75 resides in a post notch 41, in accordance with the present invention. The post notch 41 may be a notch, opening, recess, detent, indent, trough, or slot that may accommodate a portion of the conductive member 75. The post notch 41 may be curvilinear to accommodate a curvilinear conductive member 75 or the post notch 41 may form 90° angles to accommodate a square or rectangular cross-sectional conductive member 75. The post notch 41 may or may not extend 360° around the inside of the post 40. For example, a portion of the conductive member 75 may fit within in the post notch 41, while the other portion maintains direct contact with the conductive foil layer 15 providing inner dielectric continuity for a connector 100. Additionally, there may be multiple post notches 41 corresponding to multiple conductive members 75 as described supra.

Figure 9:
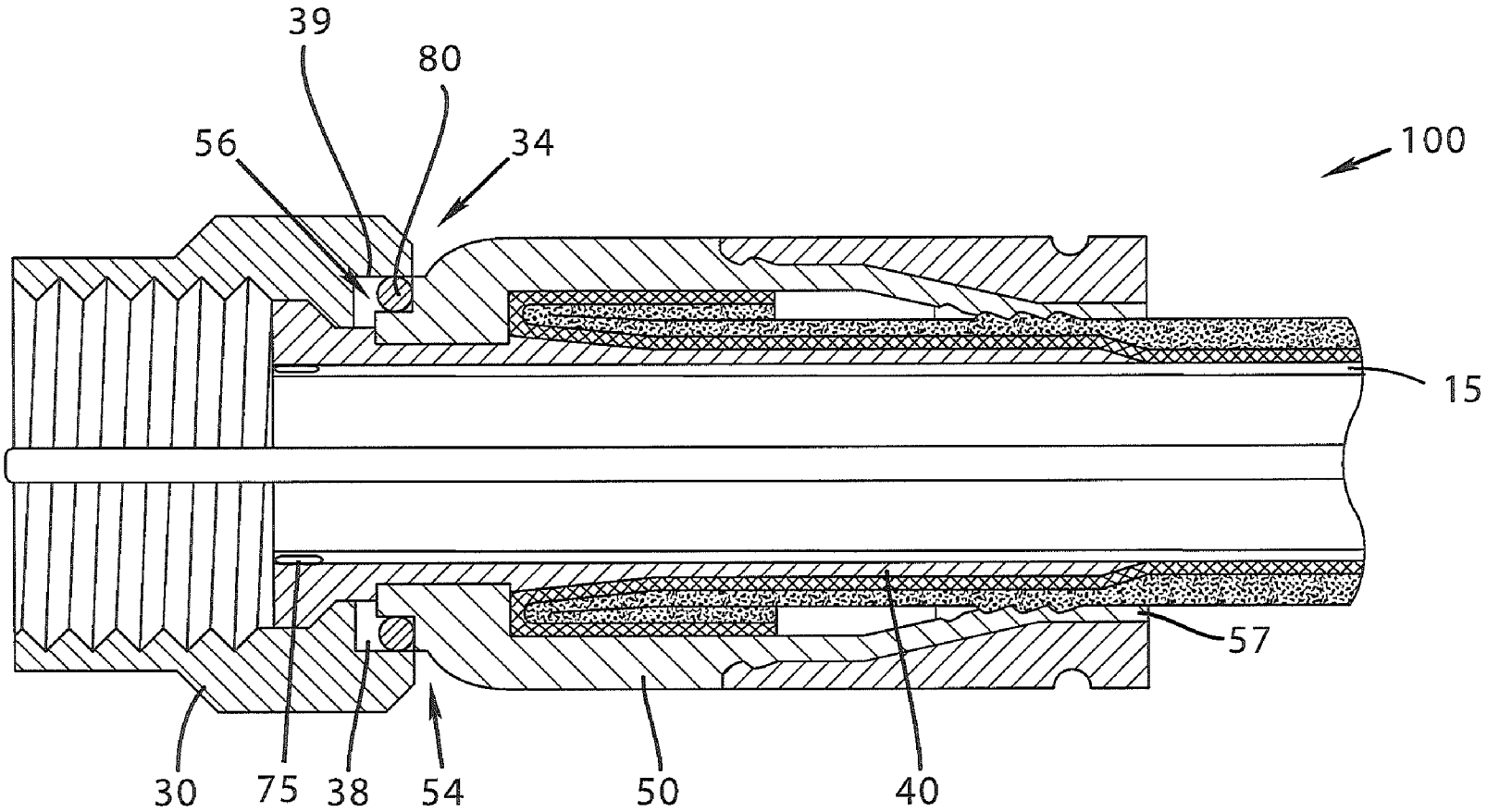
FIG. 9 depicts a sectional side view of an embodiment of a connector configured with a conductive member proximate a second end of a connector body, and a conductive member located proximate a second end of a post, in accordance with the present invention.

With still further continued reference to the drawings, FIG. 9 depicts a sectional side view of an embodiment of a connector 100 configured with a connector body conductive member 80 proximate a second end 54 of a connector body 50, and a conductive member 75 located proximate a second end 44 of post 40, in accordance with the present invention. The connector body conductive member 80 should be formed of a conductive material. Such materials may include, but are not limited to conductive polymers, plastics, elastomeric mixtures, composite materials having conductive properties, soft metals, conductive rubber, and/or the like and/or any workable combination thereof. The connector body conductive member 80 may comprise a substantially circinate torus or toroid structure, or other ring-like structure. For example, an embodiment of the connector body conductive member 80 may be an O-ring configured to cooperate with the annular recess 56 proximate the second end 54 of connector body 50 and the cavity 38 extending axially from the edge of second end 34 and partially defined and bounded by an outer internal wall 39 of threaded nut 30 (see FIG. 3) such that the connector body conductive O-ring 80 may make contact with and/or reside contiguous with the annular recess 56 of connector body 50 and outer internal wall 39 of threaded nut 30 when operably attached to post 40 of connector 100. The connector body conductive member 80 may facilitate an annular seal between the threaded nut 30 and connector body 50 thereby providing a physical barrier to unwanted ingress of moisture and/or other environmental contaminates. Moreover, the connector body conductive member 80 may facilitate electrical coupling of the connector body 50 and threaded nut 30 by extending therebetween an unbroken electrical circuit. In addition, the connector body conductive member 80 may facilitate grounding of the connector 100, and attached coaxial cable (shown in FIG. 1), by extending the electrical connection between the connector body 50 and the threaded nut 30. Furthermore, the connector body conductive member 80 may effectuate a buffer preventing ingress of electromagnetic noise between the threaded nut 30 and the connector body 50. It should be recognized by those skilled in the relevant art that the connector body conductive member 80, like the mating edge conductive member 70, may be manufactured by extruding, coating, molding, injecting, cutting, turning, elastomeric batch processing, vulcanizing, mixing, stamping, casting, and/or the like and/or any combination thereof in order to provide efficient production of the component.

Figure 9A:
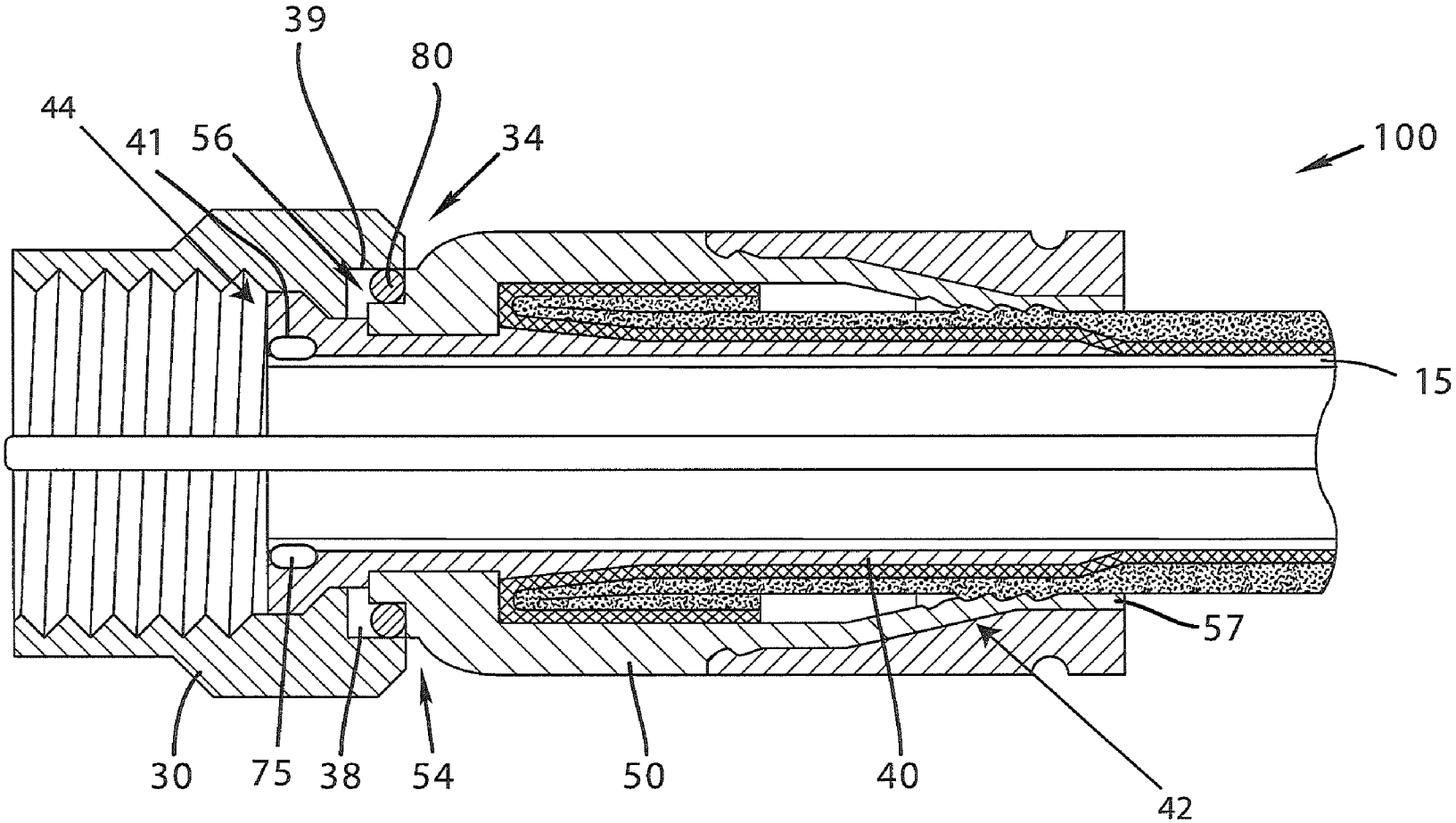
FIG. 9A depicts a sectional side view of an embodiment of a connector configured with a conductive member proximate a second end of a connector body, and a conductive member located proximate a second end of a post having a post notch, in accordance with the present invention.

FIG. 9A depicts a sectional side view of an embodiment of a connector 100 configured with connector body conductive member 80 proximate a second end 44 of a post 40, and a conductive member 75 located proximate a second end 44 of the post 40, wherein a portion of the conductive member 75 resides in a post notch 41, in accordance with the present invention. The post notch 41 may be a notch, opening, indent, recess, detent, trough, or slot that may accommodate a portion of the conductive member 75. The post notch 41 may be curvilinear to accommodate a curvilinear conductive member 75 or the post notch 41 may form 90° angles to accommodate a square or rectangular cross-sectional conductive member 75. The post notch 41 may or may not extend 360° around the inside of the post 40. For example, a portion of the conductive member 75 may fit within in the post notch 41, while the other portion maintains direct contact with the conductive foil layer 15 providing electrical continuity about an inner dielectric 16 for a connector 100.

With reference to FIGS. 1-2A and 7-9A, either one or all three of the conductive member 75, the mating edge conductive member, or O-ring 70, and connector body conductive member, or O-ring 80, may be utilized in conjunction with an integral post connector body 90. For example, the mating edge conductive member 70 may be inserted within a threaded nut 30 such that it contacts the mating edge 99 of integral post connector body 90 as implemented in an embodiment of connector 100. By further example, the connector body conductive member 80 may be position to cooperate and make contact with the recess 96 of connector body 90 and the outer internal wall 39 (see FIG. 3) of an operably attached threaded nut 30 of an embodiment of a connector 100. Those in the art should recognize that embodiments of the connector 100 may employ all three of the conductive member 75, the mating edge conductive member 70, and the connector body conductive member 80 in a single connector 100 (shown in FIGS. 2-2A). Accordingly the various advantages attributable to each of the conductive member 75, mating edge conductive member 70, and the connector body conductive member 80 may be obtained.

A method for grounding a coaxial cable 10 through a connector 100 is now described with reference to FIG. 1 which depicts a sectional side view of an embodiment of a connector 100. A coaxial cable 10 may be prepared for connector 100 attachment. Preparation of the coaxial cable 10 may involve removing the protective outer jacket 12 and drawing back the conductive grounding shield 14 to expose a portion of a conductive foil layer 15 surrounding the interior dielectric 16. Further preparation of the embodied coaxial cable 10 may include stripping the conductive foil layer 15 and dielectric 16 to expose a portion of the center conductor 18. Various other preparatory configurations of coaxial cable 10 may be employed for use with connector 100 in accordance with standard broadband communications technology and equipment. For example, the coaxial cable may be prepared without drawing back the conductive grounding shield 14, but merely stripping a portion thereof to expose the conductive foil layer 15, the interior dielectric 16, and center conductor 18.

Referring back to FIG. 1, further depiction of a method for grounding a coaxial cable 10 through a connector 100 is described. A connector 100 including a post 40 having a first end 42 and second end 44 may be provided. Moreover, the provided connector may include a connector body 50 and a conductive member 75 located proximate the second end 44 of post 40. The proximate location of the conductive member 75 should be such that the conductive member 75 makes physical and electrical contact with post 40. In one embodiment, the conductive member 75 may be press-fit, attached, adhered, placed, positioned, etc. on an inner surface of the post 40 proximate the second 44 to establish physical and electrical contact. For example, the conductive member 75 may be press-fit, attached, adhered, placed, positioned, etc. along the inside or inside of the post 40. In another embodiment, the conductive member 75 may be positioned, located, placed, etc. in a post notch 41, wherein a portion, or first surface, of the conductive member 75 resides in the post notch 41, and the other portion, or second surface, of the conductive member 75 maintains physical and electrical contact with the post 40.

Grounding may be further attained and maintained by fixedly attaching the coaxial cable 10 to the connector 100. Attachment may be accomplished by insetting the coaxial cable 10 into the connector 100 such that the first end 42 of post 40 is inserted under the conductive grounding sheath or shield 14 and around the conductive foil layer 15 encompassing the dielectric 16. Where the post 40 is comprised of conductive material, a grounding connection may be achieved between the received conductive grounding shield 14 of coaxial cable 10 and the inserted post 40. The ground may extend through the post 40 from the first end 42 where initial physical and electrical contact is made with the conductive grounding shield 14 to the second end 44 of the post 40. Once received, the coaxial cable 10 may be securely fixed into position by radially compressing the outer surface 57 of connector body 50 against the coaxial cable 10 thereby affixing the cable into position and sealing the connection. Furthermore, radial compression of a resilient member placed within the connector 100 may attach and/or the coaxial cable 10 to connector 100. In addition, the radial compression of the connector body 50 may be effectuated by physical deformation caused by a fastener member 60 that may compress and lock the connector body 50 into place. Moreover, where the connector body 50 is formed of materials having and elastic limit, compression may be accomplished by crimping tools, or other like means that may be implemented to permanently deform the connector body 50 into a securely affixed position around the coaxial cable 10.

Figure 10:
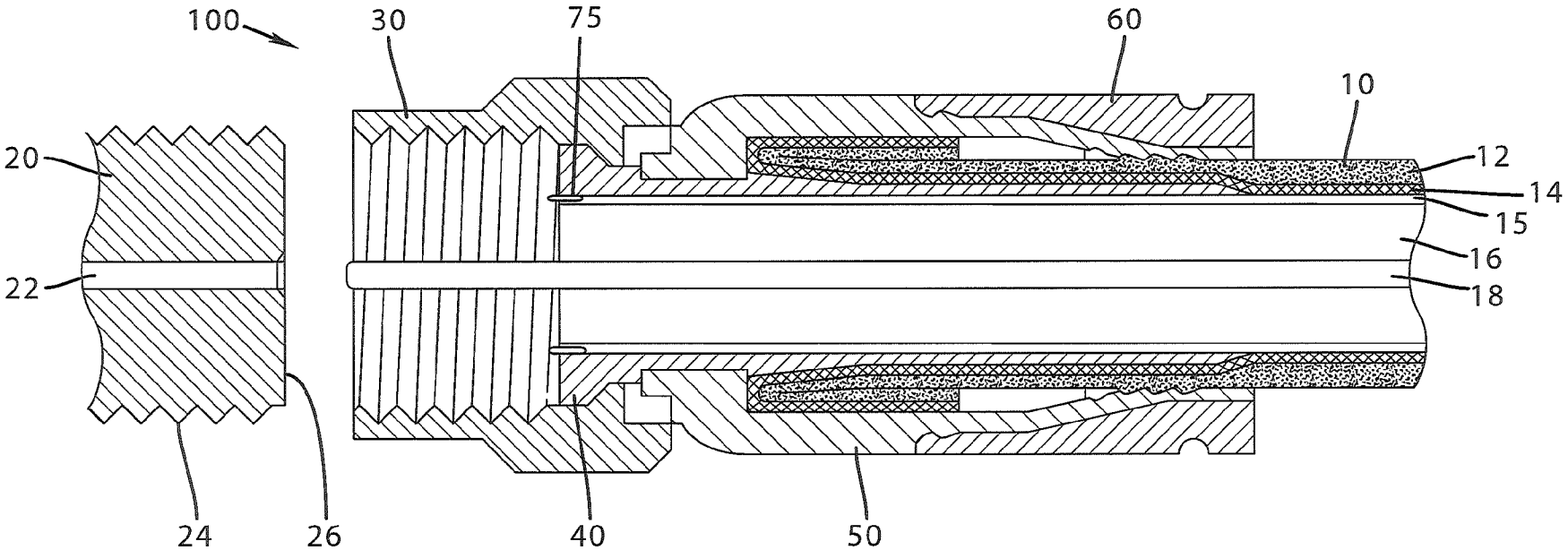
FIG. 10 depicts a sectional side view of an embodiment of a connector configured with a conductive member located proximate the second end of a post, the conductive member extending a distance from the post, in accordance with the present invention.
Figure 10A:
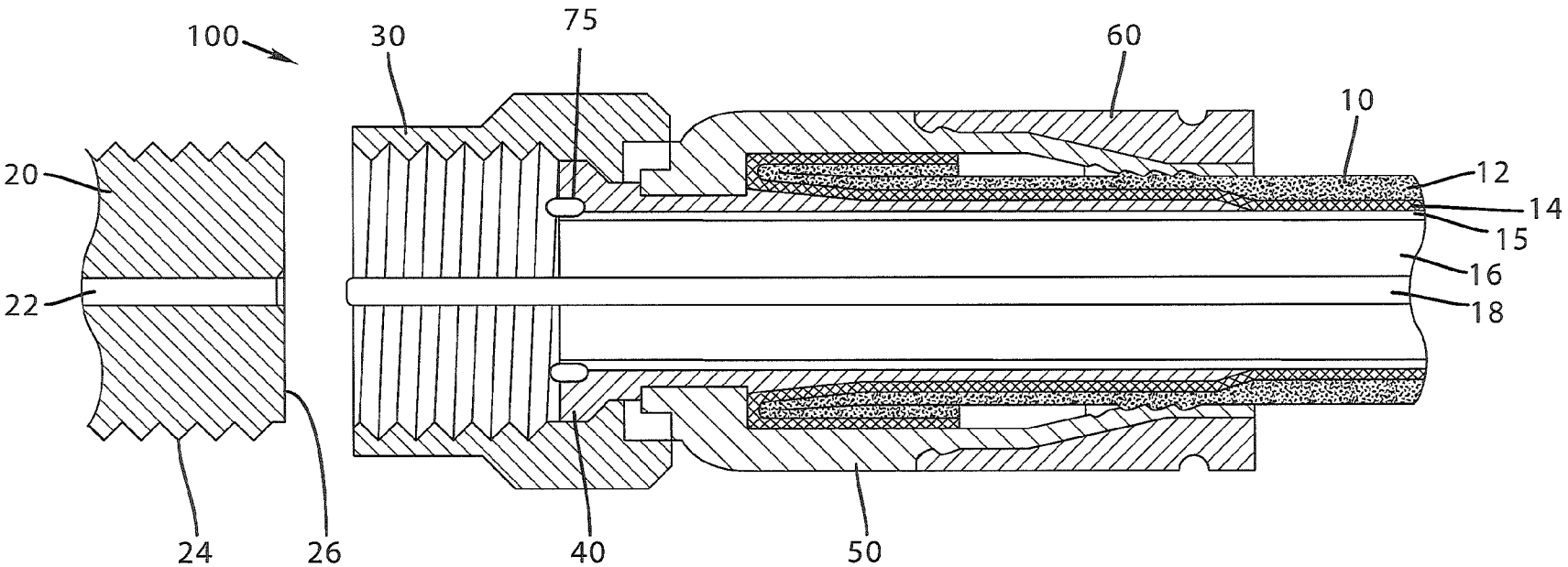
FIG. 10A depicts a sectional side view of an embodiment of a connector configured with a conductive member located proximate a second end of a post having a post notch, the conductive member extending a distance from the post, in accordance with the present invention.

As an additional step, grounding of the coaxial cable 10 through the connector 100 may be accomplished by advancing the connector 100 onto an interface port 20 until a surface of the interface port mates with the conductive member 75. Because the conductive member 75 is located such that it makes physical and electrical contact with post 40, grounding may be extended from the post 40 through the conductive member 75 and then through the mated interface port 20. Accordingly, the interface port 20 should make physical and electrical contact with the conductive member 75. Advancement of the connector 100 onto the interface port 20 may involve the threading on of attached threaded nut 30 of connector 100 until a surface of the interface port 20 abuts the conductive member 75 and axial progression of the advancing connector 100 is hindered by the abutment. In one embodiment, the conductive member 75 may be flush with the mating edge 49 of the post 40, such that the interface port 20 physically contacts the mating edge 49, thereby establishing physical and electrical contact with the conductive member 75 located therebetween. In another embodiment, the conductive member 75 may extend a distance from or outward from the mating edge 49, such that a surface of the interface port 20 need not physically contact the mating edge 49, yet may still establish physical and electrical contact with the conductive member 75 (shown in FIGS. 10-10A). Establishing and maintaining physical and electrical contact between the conductive member 75 and the interface port 20 without requiring the interface port 20, in particular a surface of the interface port 20, from physically contacting the mating edge 49 may still ground the coaxial cable 10 in the event the user fails to sufficiently or properly advance the interface port 20 completely towards the connector 100.

However, it should be recognized that embodiments of the connector 100 may be advanced onto an interface port 20 without threading and involvement of a threaded nut 30. Once advanced until progression is stopped by the conductive contact of the conductive member 75 with interface port 20, the connector 100 may be further shielded from ingress of unwanted electromagnetic interference. Moreover, grounding may be accomplished by physical advancement of various embodiments of the connector 100 wherein a conductive member 75 facilitates electrical connection of the connector 100 and attached coaxial cable 10 to an interface port 20.

With continued reference to FIG. 2 and additional reference to FIG. 8, further depiction of a method for grounding a coaxial cable 10 through a connector 100 is described. A connector 100 including a post 40 having a first end 42 and second end 44 may be provided. Moreover, the provided connector may include a connector body 50 and a mating edge conductive member 70 located proximate the second end 44 of post 40. The proximate location of the mating edge conductive member 70 should be such that the mating edge conductive member 70 makes physical and electrical contact with post 40. In one embodiment, the mating edge conductive member or O-ring 70 may be inserted into a threaded nut 30 until it abuts the mating edge 49 of post 40. However, other embodiments of connector 100 may locate the mating edge conductive member 70 at or very near the second end 44 of post 40 without insertion of the mating edge conductive member 70 into a threaded nut 30.

Grounding may be further attained by fixedly attaching the coaxial cable 10 to the connector 100. Attachment may be accomplished by insetting the coaxial cable 10 into the connector 100 such that the first end 42 of post 40 is inserted under the conductive grounding sheath or shield 14 and around the conductive foil layer 15 and dielectric 16. Where the post 40 is comprised of conductive material, a grounding connection may be achieved between the received conductive grounding shields 14 of coaxial cable 10 and the inserted post 40. The ground may extend through the post 40 from the first end 42 where initial physical and electrical contact is made with the conductive grounding shield 14 to the mating edge 49 located at the second end 44 of the post 40. Once, received, the coaxial cable 10 may be securely fixed into position by radially compressing the outer surface 57 of connector body 50 against the coaxial cable 10 thereby affixing the cable into position and sealing the connection. The radial compression of the connector body 50 may be effectuated by physical deformation caused by a fastener member 60 that may compress and lock the connector body 50 into place. Moreover, where the connector body 50 is formed of materials having and elastic limit, compression may be accomplished by crimping tools, or other like means that may be implemented to permanently deform the connector body 50 into a securely affixed position around the coaxial cable 10.

As an additional step, grounding of the coaxial cable 10 through the connector 100 may be accomplished by advancing the connector 100 onto an interface port 20 until a surface of the interface port mates with the mating edge conductive member 70. Because the mating edge conductive member 70 is located such that it makes physical and electrical contact with post 40, grounding may be extended from the post 40 through the mating edge conductive member 70 and then through the mated interface port 20. Accordingly, the interface port 20 should make physical and electrical contact with the mating edge conductive member 70. The mating edge conductive member 70 may function as a conductive seal when physically pressed against the interface port 20. Advancement of the connector 100 onto the interface port 20 may involve the threading on of attached threaded nut 30 of connector 100 until a surface of the interface port 20 abuts the mating edge conductive member 70 and axial progression of the advancing connector 100 is hindered by the abutment. However, it should be recognized that embodiments of the connector 100 may be advanced onto an interface port 20 without threading and involvement of a threaded nut 30. Once advanced until progression is stopped by the conductive sealing contact of mating edge conductive member 70 with interface port 20, the connector 100 may be shielded from ingress of unwanted electromagnetic interference. Moreover, grounding may be accomplished by physical advancement of various embodiments of the connector 100 wherein a mating edge conductive member 70 facilitates electrical connection of the connector 100 and attached coaxial cable 10 to an interface port 20.

A method for electrically coupling a connector 100 and a coaxial cable 10 is now described with reference to FIG. 2. A coaxial cable 10 may be prepared for fastening to connector 100. Preparation of the coaxial cable 10 may involve removing the protective outer jacket 12 and drawing back the conductive grounding shield 14 to expose the conductive foil layer 15 surrounding the interior dielectric 16. Further preparation of the embodied coaxial cable 10 may include stripping the dielectric 16 to expose a portion of the center conductor 18.

With continued reference to FIG. 2 and additional reference to FIG. 9, further depiction of a method for electrically coupling a coaxial cable 10 and a connector 100 is described. A connector 100 including a connector body 50 and a threaded nut 30 may be provided. Moreover, the provided connector may include a connector body conductive member or seal 80. The connector body conductive member or seal 80 should be configured and located such that the connector body conductive member 80 electrically couples and physically seals the connector body 50 and threaded nut 30. In one embodiment, the connector body conductive member or seal 80 may be located proximate a second end 54 of a connector body 50. The connector body conductive member 80 may reside within a cavity 38 of threaded nut 30 such that the connector body conductive member 80 lies between the connector body 50 and threaded nut 30 when attached. Furthermore, the particularly embodied connector body conductive member 80 may physically contact and make a seal with outer internal wall 39 of threaded nut 30. Moreover, the connector body conductive member 80 may physically contact and seal against the surface of connector body 50. Accordingly, where the connector body 50 is comprised of conductive material and the threaded nut 30 is comprised of conductive material, the connector body conductive member 80 may electrically couple the connector body 50 and the threaded nut 30. Various other embodiments of connector 100 may incorporate a connector body conductive member 80 for the purpose of electrically coupling a coaxial cable 10 and connector 100. For example, the connector body conductive member, such as O-ring 80, may be located in a recess on the outer surface of the threaded nut 30 such that the connector body conductive O-ring 80 lies between the nut and an internal surface of connector body 50, thereby facilitating a physical seal and electrical couple.

Electrical coupling may be further accomplished by fixedly attaching the coaxial cable 10 to the connector 100. The coaxial cable 10 may be inserted into the connector body 50 such that the conductive grounding shield 14 makes physical and electrical contact with and is received by the connector body 50 and/or the post 40. In one embodiment of the connector 100, the drawn back conductive grounding shield 14 may be pushed against the inner surface of the connector body 50 when inserted. Once received, or operably inserted into the connector 100, the coaxial cable 10 may be securely set into position by compacting and deforming the outer surface 57 of connector body 50 against the coaxial cable 10 thereby affixing the cable into position and sealing the connection. Compaction and deformation of the connector body 50 may be effectuated by physical compression caused by a fastener member 60, wherein the fastener member 60 constricts and locks the connector body 50 into place. Moreover, where the connector body 50 is formed of materials having and elastic limit, compaction and deformation may be accomplished by crimping tools, or other like means that may be implemented to permanently contort the outer surface 57 of connector body 50 into a securely affixed position around the coaxial cable 10.

A further method step of electrically coupling the coaxial cable 10 and the connector 100 may be accomplished by completing an electromagnetic shield by threading the threaded nut 30 onto a conductive interface port 20. Where the connector body 50 and threaded nut 30 are formed of conductive materials, an electrical circuit may be formed when the conductive interface port 20 contacts the threaded nut 30 because the connector body conductive member 80 extends the electrical circuit and facilitates electrical contact between the threaded nut 30 and connector body 50. Moreover, the realized electrical circuit works in conjunction with physical screening performed by the connector body 50 and threaded nut 30 as positioned in barrier-like fashion around a coaxial cable 10 when fixedly attached to a connector 100 to complete an electromagnetic shield where the connector body conductive member 80 also operates to physically screen electromagnetic noise. Thus, when threaded onto an interface port 20, the completed electrical couple renders electromagnetic protection, or EMI shielding, against unwanted ingress of environmental noise into the connector 100 and coaxial cable 10.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising:

a connector body attached to a post, wherein the post has a first end and a second end, the first end configured to be inserted into an end of the coaxial cable around the foil layer encompassing the dielectric and under the conductive grounding shield thereof;

a rotatable coupling element attached to the post; and a conductive member positioned along an inner surface of the post facilitating continuous electrical communication between the foil layer and the post, when the first end of the post is inserted into the end of the coaxial cable around the foil layer encompassing the dielectric and under the conductive grounding shield thereof.

2. The connector of claim 1, wherein a plurality of conductive members are located along the inner surface of the post.

3. The connector of claim 1, wherein the connector body includes a first end and a second end, the first end configured to deformably compress against and seal a received coaxial cable.

4. The connector of claim 1, wherein the conductive member is resilient.

5. The connector of claim 1, wherein the conductive member is rigid.

6. The connector of claim 1, wherein a conductive seal is located proximate the second end of the connector body, and further wherein the seal is configured to provide a shield for preventing ingress of electromagnetic noise into the connector.

7. The connector of claim 1, wherein the conductive member is configured to provide a shield for preventing ingress of electromagnetic noise into the connector.

8. The connector of claim 1, wherein the post has a notch proximate the second end, the notch accommodating a first surface of the conductive member, while a second surface of the conductive member maintains contact with the foil layer.

9. The connector of claim 8, wherein the post has a plurality of post notches.

10. The connector of claim 1, further comprising: a conductive mating member, located proximate the second end of the post, wherein the conductive member facilitates grounding of the coaxial cable; and wherein the conductive mating member forms a shield preventing ingress of electromagnetic noise into the connector.

11. The connector of claim 1, wherein the conductive member extends a distance from the post.

12. A connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising:

a connector body attached to a post wherein the connector body includes a first end and a second end, the first end configured to deformably compress against and seal a received coaxial cable;

a rotatable coupling element attached to the post; and a conductive member located along an inner surface of the post, wherein the conductive member facilitates the grounding of the coaxial cable by electrically coupling the foil layer to the post.

13. The connector of claim 12, wherein the post has a first end and a second end, the first end configured to be inserted into an end of the coaxial cable around the foil layer encompassing the dielectric and under the conductive grounding shield thereof.

14. The connector of claim 12, wherein the conductive member extends a distance from the post.

15. The connector of claim 12, wherein a conductive seal is located proximate the second end of the connector body, and further wherein the seal is configured to provide a shield for preventing ingress of electromagnetic noise into the connector.

16. The connector of claim 12, wherein the conductive member is configured to provide a shield for preventing ingress of electromagnetic noise into the connector.

17. The connector of claim 12, wherein the post has a notch proximate the second end, the notch accommodating a first surface of the conductive member, while a second surface of the conductive member maintains contact with the foil layer.

18. The connector of claim 12, further comprising:

a conductive mating member, located proximate the second end of the post, wherein the conductive member facilitates grounding of the coaxial cable; and wherein the conductive mating member completes a shield preventing ingress of electromagnetic noise into the connector.

19. A connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising:

a connector body having a first end and a second end, the first end configured to deformably compress against and seal a received coaxial cable;

a post attached to the connector body, wherein the post includes a first end and a second end, the first end configured to be inserted into an end of the coaxial cable around the foil layer encompassing the dielectric and under the conductive grounding shield thereof;

a port coupling element attached to the post; and a plurality of conductive members, wherein at least one of the plurality of conductive members is positioned along an inner surface of the post, and further wherein the plurality of conductive members helps complete a shield preventing ingress of electromagnetic noise into the connector and facilitates grounding of the coaxial cable.

20. The connector of claim 19, wherein the plurality of conductive members comprise a first conductive member, a second conductive member, and a third conductive member.

21. The connector of claim 20, wherein the first conductive member is positioned to electrically couple the foil layer and the post.

22. The connector of claim 20, wherein the second conductive member is a conductive sealing member located proximate the second end of the connector body for electrically coupling and physically sealing the connector body and the threaded nut.

23. The connector of claim 20, wherein the third conductive member is a conductive mating member located proximate the second end of the post and facilitates an annular seal between the threaded nut and the post thereby electrical coupling the post and the threaded nut by extending therebetween an unbroken electrical circuit.

24. A connector for coupling an end of a coaxial cable, the coaxial cable having a center conductor surrounded by a dielectric, the dielectric being surrounded by a foil layer, the foil layer being surrounded by a conductive grounding shield, the conductive grounding shield being surrounded by a protective outer jacket, the connector comprising:

a connector body having a first end and a second end, the first end configured to deformably compress against and seal a received coaxial cable;

a post attached to the connector body, wherein the post includes a first end and a second end, the first end configured to be inserted into an end of the coaxial cable around the foil layer encompassing the dielectric and under the conductive grounding shield thereof;

a port coupling element attached to the post; and means for electrically coupling the post and the foil layer, thereby establishing electrical continuity about the dielectric.

25. A method for grounding a coaxial cable through a connector, the coaxial cable having a center conductor surrounded by a dielectric, the dielectric being surrounded by a foil layer, the foil layer being surrounded by a conductive grounding shield, the conductive grounding shield being surrounded by a protective outer jacket, the method comprising:

providing a coaxial cable connector having a post positioned within a connector body of the coaxial cable connector;

positioning a first conductive member on an inner surface of the post, wherein the first conductive member contacts both the foil layer and the post establishing and maintaining electrical continuity;

fixedly attaching the coaxial cable to the connector; and connecting the connector onto an interface port so that the first conductive member facilitates grounding through the connector.

26. The method of claim 25, wherein the connector further includes a threaded nut, and a second conductive member electrically coupling and physically sealing the connector body and threaded nut.

27. The method of claim 25, wherein the first conductive member extends a distance from the post to contact the surface of the interface port before the interface port contacts a mating surface of the post.

28. The method of claim 25, further including completing an electromagnetic shield by rotating the nut and threading it onto the conductive interface port.

29. The method of claim 25, wherein the first conductive member electrically couples and physically seals at least a portion of the connector.

* * * * *